US006966626B2

(12) United States Patent
Hayashi

(10) Patent No.: US 6,966,626 B2
(45) Date of Patent: Nov. 22, 2005

(54) PRINTING STRATEGY FOR CONSIDERING VARIABLE DOT SIZE DEPENDENT ON PERIPHERAL PIXEL DOT RECORDING STATUS

(75) Inventor: Toshihiro Hayashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 434 days.

(21) Appl. No.: 10/395,851

(22) Filed: Mar. 25, 2003

(65) Prior Publication Data

US 2004/0090489 A1 May 13, 2004

(30) Foreign Application Priority Data

Mar. 27, 2002 (JP) ..... 2002-088888

(51) Int. Cl.[7] ..... B41J 2/15
(52) U.S. Cl. ..... 347/41
(58) Field of Search ..... 347/41, 12, 40, 347/15, 43, 16, 37

(56) References Cited

U.S. PATENT DOCUMENTS 6,565,192 B1 * 5/2003 Vinals et al. ..... 347/41
6,779,872 B2 * 8/2004 Shioya et al. ..... 347/41

* cited by examiner

*Primary Examiner*—Lamson Nguyen
(74) *Attorney, Agent, or Firm*—Sughrue Mion, PLLC

(57) ABSTRACT

The technique is provided that reduces degraded quality in printed results due to nozzles employed to record dots on each pixel in combination with the order in which these dots are recorded on pixels. A plurality of nozzles on a print head are grouped, in order from the nozzles that first reach a point over the print medium, into a first nozzle group, a second nozzle group, and a third nozzle group. During main scanning, certain pixels in main scan lines positioned facing the nozzles of the first nozzle group are targeted for dot recording. All pixels contained in main scan lines positioned facing the nozzles of the second nozzle group are targeted for dot recording. Those pixels among the pixels contained in main scan lines positioned facing the nozzles of the third nozzle group, and that have not previously had dots recorded thereon by the first nozzle group in a previous main scan, are targeted for dot recording. The number of pixels N1 recorded by the first nozzle group and the number of pixels N3 recorded by the third nozzle group in the course of a single main scan is adjusted to a suitable ratio.

15 Claims, 14 Drawing Sheets

PRINTING STRATEGY FOR CONSIDERING VARIABLE DOT SIZE DEPENDENT ON PERIPHERAL PIXEL DOT RECORDING STATUS

BACKGROUND OF THE INVENTION

1. Field of the Invention

This invention relates to a printing device, and in particular to a technique for performing printing by forming dots on a print medium while performing main scanning and sub-scanning.

2. Description of the Related Art

In recent years, printing devices that eject ink droplets from nozzles while performing main scanning to form dots on a print medium have come to enjoy widespread use as computer output devices. Dot recording modes employed in such printing devices include "non-overlap print mode" in which dots on each main scan line of printing paper are recorded with ink ejected from a single nozzle, and "overlap print mode" in which dots on each main scan line of printing paper are recorded with ink ejected from two or more nozzles. Additionally, there is a "partial overlap print mode" in which only certain main scan lines are printed in a manner analogous to overlap print mode.

In printing modes that involve main scanning and sub-scanning, recording movement of a given pattern is repeated in the sub-scanning direction. In each pattern movement, the positional relationship in which dots are recorded on each pixel is fixed and the order in which these dots are recorded on pixels is also fixed. The printed pattern resulting from the nozzles employed to record dots on each pixel in combination with the order in which these dots are recorded on pixels is herein referred to as "texture." If texture repeated in the sub-scanning direction on printing paper is conspicuous, a noticeable stripe pattern will appear in areas that should be filled with a single color, resulting in diminished quality of the printed result.

In view of the aforementioned drawbacks pertaining to the prior art, it is an object of the present invention to provide a technique for reducing degraded quality in printed results due to nozzles employed to record dots on each pixel in combination with the order in which these dots are recorded on pixels.

SUMMARY OF THE INVENTION

To solve the aforementioned problem at least in part, the present invention employs a predetermined process in a printing device that performs printing by ejecting ink droplets from nozzles and depositing them on a print medium to form dots. The printing device comprises: a print head equipped with a plurality of nozzles for ejecting ink droplets of a same given color; a main scan drive unit for performing main scanning by moving at least one of the print head and the print medium; a sub-scan drive unit for performing the sub-scanning by moving at least one of the print head and the print medium in a direction intersecting a direction of the main scanning; and a control unit for controlling each unit. The plurality of nozzles are arranged in the direction of sub-scanning at a nozzle pitch equivalent to some multiple k (k is an integer equal to 1 or greater) of a main scan line pitch.

Using the printing device, ink droplets are deposited onto the print medium to form dots while being performed main scanning by moving at least one of the print head and the print medium. The sub-scanning is performed by moving the print medium by a specific feed distance in a direction intersecting a direction of the main scanning.

It is preferable that the plurality of nozzles include a prior nozzle group and a posterior nozzle group along the direction of sub-scanning in order from a nozzle group that first reaches a point over the print medium during sub-scanning. The posterior nozzle group is preferably provided over an area equal in width to that of the prior nozzle group in the direction of sub-scanning. During the main scanning, first partial line recording is performed using the prior nozzle group, wherein some of pixels among pixels included in main scan lines positioned facing nozzles of the prior nozzle group are targeted for dot recording. Second partial line recording is also performed using the posterior nozzle group, wherein those pixels among pixels included in main scan lines positioned facing nozzles of the posterior nozzle group and that have not previously had dots recorded thereon by the prior nozzle group in previous main scans are targeted for dot recording.

The first and second partial line recording are performed in such a manner that a number N1 (N1 being a positive integer) of pixels are targeted for recording by nozzles of the prior nozzle group in the first partial line recording in a single main scan, a number N3 (N3 being a positive integer) of pixels are targeted for recording by nozzles of the posterior nozzle group in the second partial line recording in the single main scan, and the number N1 is a different value from the number N3. According to this embodiment, differences in printed results between areas printed by the prior nozzle group and posterior nozzle group on the one hand, and areas printed by a single nozzle group on the other, can be rendered inconspicuous.

In case that the plurality of nozzles further includes a middle nozzle group provided in a position between the prior nozzle group and the posterior nozzle group in the direction of sub-scanning, it is preferable that during the main scanning, entire line recording is performed using the middle nozzle group, wherein all pixels included in main scan lines positioned facing nozzles of the middle nozzle group are targeted for dot recording. According to this embodiment, differences in printed results between areas printed by the prior nozzle group and posterior nozzle group on the one hand, and areas printed by the middle nozzle group on the other, can be rendered inconspicuous. The nozzle pitch k is preferably an integer equal to 2 or greater.

When sub-scanning is performed, it is preferable that the sub-scanning is performed by a specific feed distance that approximates a width provided to the posterior nozzle group in the direction of sub-scanning. By so doing, dots can be recorded efficiently on pixels in a given main scan line, using the prior nozzle group and posterior nozzle group.

W1 denotes area of a dot when the dot is recorded by ejecting an ink droplet of specific weight from the nozzle onto a pixel surrounded by adjacent pixels having no dots recorded thereon. W2 denotes area of a dot when the dot is recorded by ejecting an ink droplet of the specific weight from the nozzle onto a pixel that has an adjacent pixel which has a dot recorded thereon to one side thereof in the direction of sub-scanning, and remaining surrounding adjacent pixels which have no dots recorded thereon. W3 denotes area of a dot when the dot is recorded by ejecting an ink droplet of the specific weight from the nozzle onto a pixel that has two adjacent pixels each of which has a dot recorded thereon to both sides thereof in the direction of sub-scanning, and remaining surrounding adjacent pixels which have no dots recorded thereon. In preferred practice, when recording dots with the prior nozzle group, values for N1 and N3 such that the value of W13, given by Equation (1) hereinbelow, approximates W2 will be determined in advance, and N1 pixels targeted for recording of dots thereon.

$$W13=\{W1\times N1/(N1+N3)\}+\{W3\times N3/(N1+N3)\} \quad (1)$$

In preferred practice, when recording dots with the posterior nozzle group, N3 pixels will be targeted for recording of dots thereon, on the basis of a value for N3 such that the value of W13, given by Equation (1) above, approximates W2. By so doing, the expected value for dot size in areas recorded by the prior nozzle group and posterior nozzle group can be brought into approximation with the dot size in areas recorded by the middle nozzle group.

The invention may take the form of a number of different embodiments, described hereinbelow.

(1) Printing method, printing control method.
(2) Printing device, printing control device.
(3) Computer program for realizing the device or method.
(4) Recording medium having recorded thereon a computer program for realizing the device or method.
(5) Data signal embodied in a carrier wave, including a computer program for realizing the device or method.

These and other objects, features, aspects, and advantages of the present invention will become more apparent from the following detailed description of the preferred embodiments with the accompanying drawings.

DESCRIPTION OF THE PREFERRED EMBODIMENTS

The embodiments of the invention are described hereinbelow through examples, given in the following order.

A. Embodiment 1
A1. Arrangement of the device
A2. Printing
B. Embodiment 2
C. Variations

A. Embodiment 1

A1. Arrangement of the Device

Figure 1:
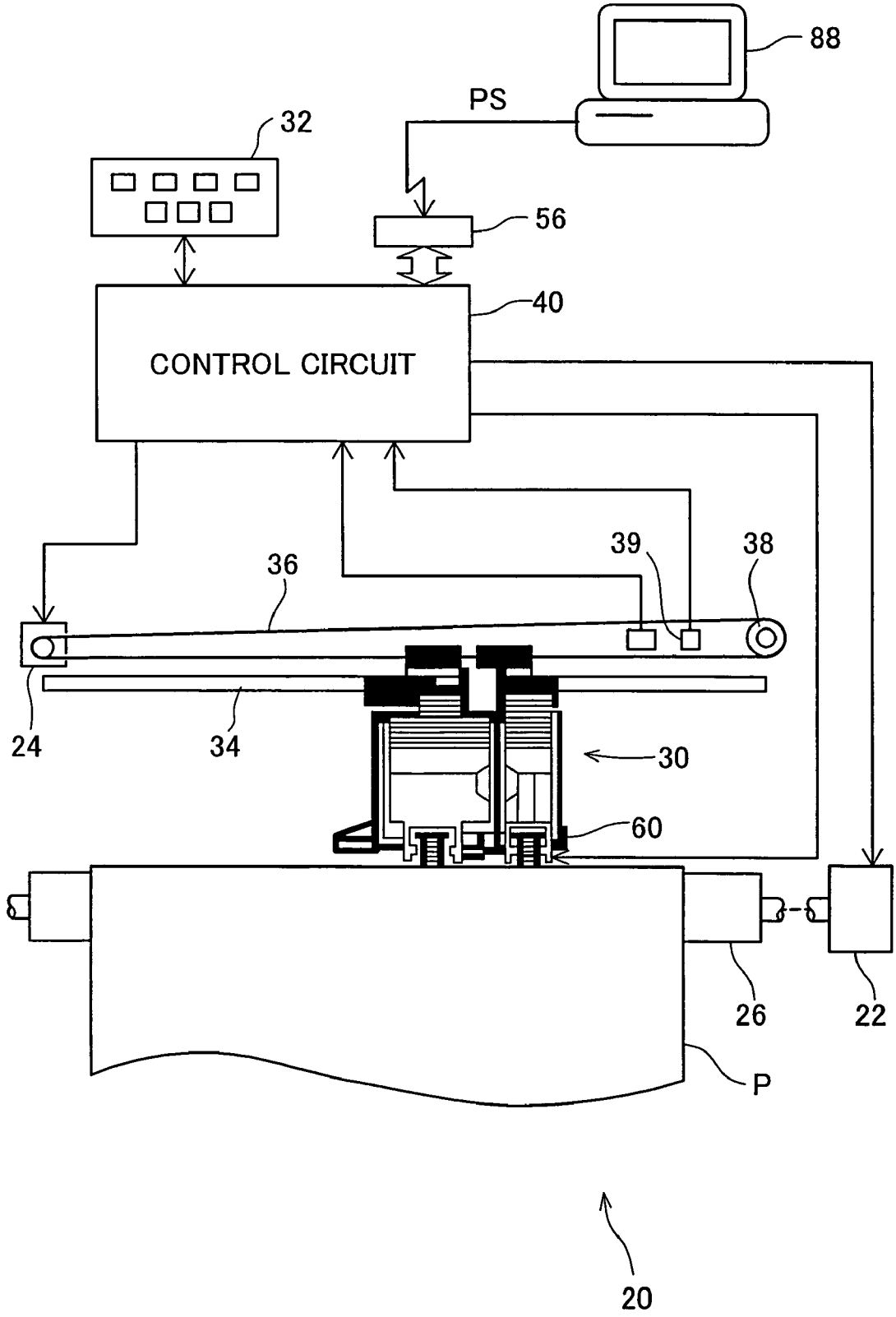
FIG. 1 is a schematic diagram showing a printing system comprising an ink-jet printer 20 by way of an embodiment of the invention.

FIG. 1 is a schematic diagram showing a printing system comprising an ink-jet printer 20 by way of an embodiment of the invention. Printer 20 comprises a main scanning mechanism for reciprocating a carriage 30 along a slide rail 34 by means of a carriage motor 24; a sub-scanning mechanism for transporting paper P in the perpendicular direction (sub-scanning direction) to the main scanning direction by means of a paper feed motor 22; a head drive mechanism for driving a print head unit 60 installed on carriage 30 to control ejection of ink and dot formation thereby; and a control circuit for exchanging signals with the paper feed motor 22, carriage motor 24, print head unit 60, and a control panel 32. Control circuit 40 is connected to a computer 88 via a connector 56.

The sub-scanning mechanism for transporting printing paper P comprises a gear train (not shown) for transmitting rotation of the paper feed motor 22 to paper feed rollers (not shown). The main scan feed mechanism for reciprocating the carriage 30 comprises a slide rail 34 extending perpendicular to the printing paper P feed direction, for slidably retaining the carriage 30; a pulley 38 around which is strained an endless belt 36 that extends between the carriage 30 and the carriage motor 24; and a position sensor 39 for sensing the starting position of the carriage 30.

Figure 2:
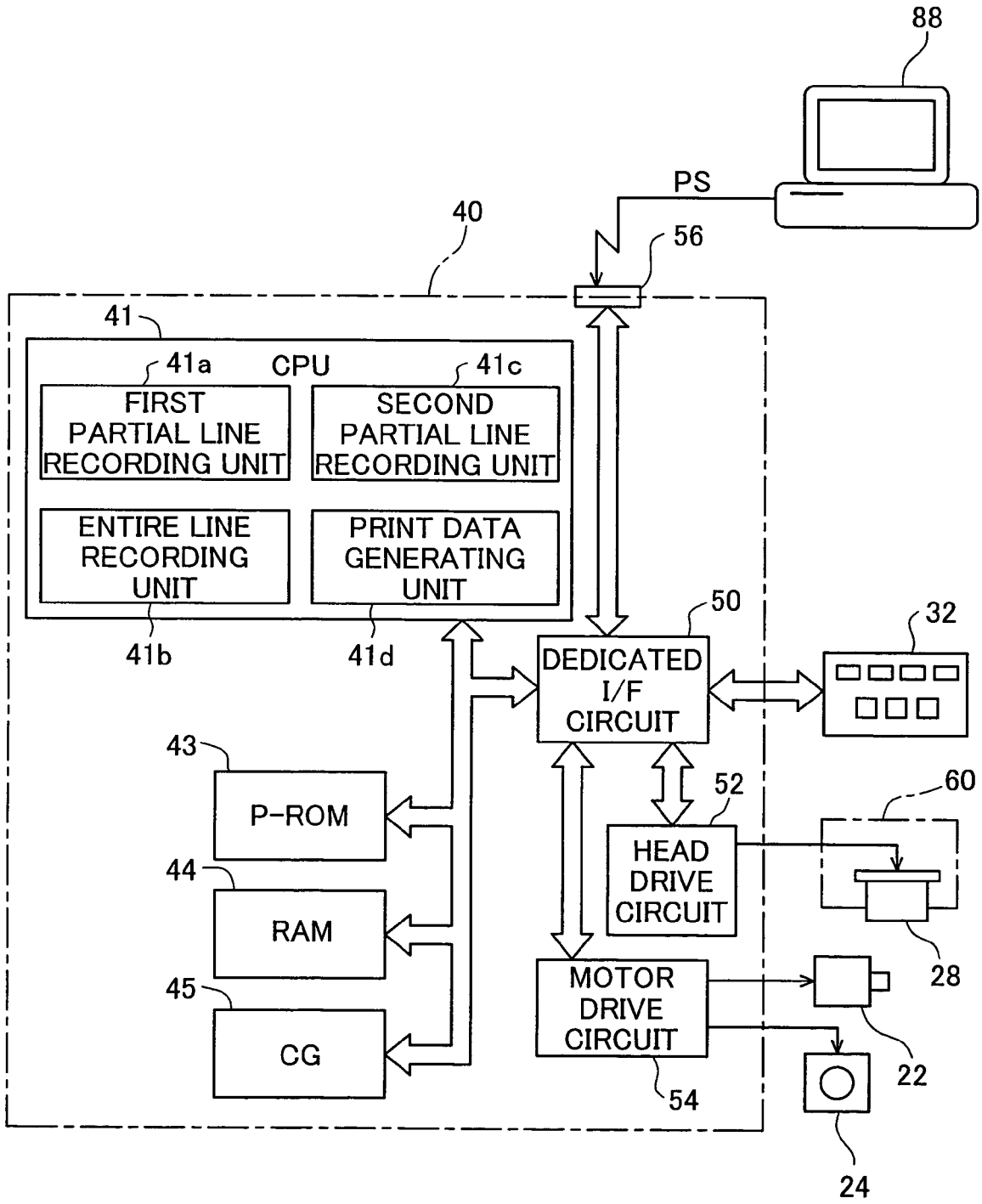
FIG. 2 is a block diagram depicting the arrangement of the control circuit 40 of printer 20.

FIG. 2 is a block diagram depicting the arrangement of the control circuit 40 of printer 20. The control circuit 40 in the drawing is designed as an arithmetic/logic circuit comprising a CPU 41, programmable ROM (PROM) 43, RAM 44, and a character generator (CG) 45 for storing character dot matrices. The control circuit 40 additionally comprises a dedicated I/F circuit 50 dedicated to exclusive interface with external motors, etc.; a head drive circuit 52 for driving the print head unit 60 to eject ink; and a motor drive circuit 54 for actuating the paper feed motor 22 and carriage motor 24.

Dedicated I/F circuit 50 includes a parallel interface circuit allowing it to receive a print signal PS supplied by computer 88 via connector 56. CPU 41 receives a print signal PS via dedicated I/F circuit 50, and places it in RAM 44. CPU 41 executes a program stored in P-ROM 43 to perform "first partial line recording", "entire line recording", or "second partial line recording", described hereinbelow.

Print head 28 is furnished with a plurality of nozzles n arranged in columns for each color; and an actuator circuit 90 for driving a piezo element PE provided to each nozzle n. Actuator circuit 90 performs ON/OFF control of a drive signal presented by a drive signal generating circuit (not shown) located in the head drive circuit 52. That is, in accordance with print data created by CPU 41 on the basis of image data contained in a print signal PS, the actuator circuit 90 latches data for each nozzle indicating whether it should be ON (i.e. eject ink) or OFF (i.e. not eject ink), and applies a drive signal to the piezo elements PE of only those nozzles designated as ON.

Figure 3:
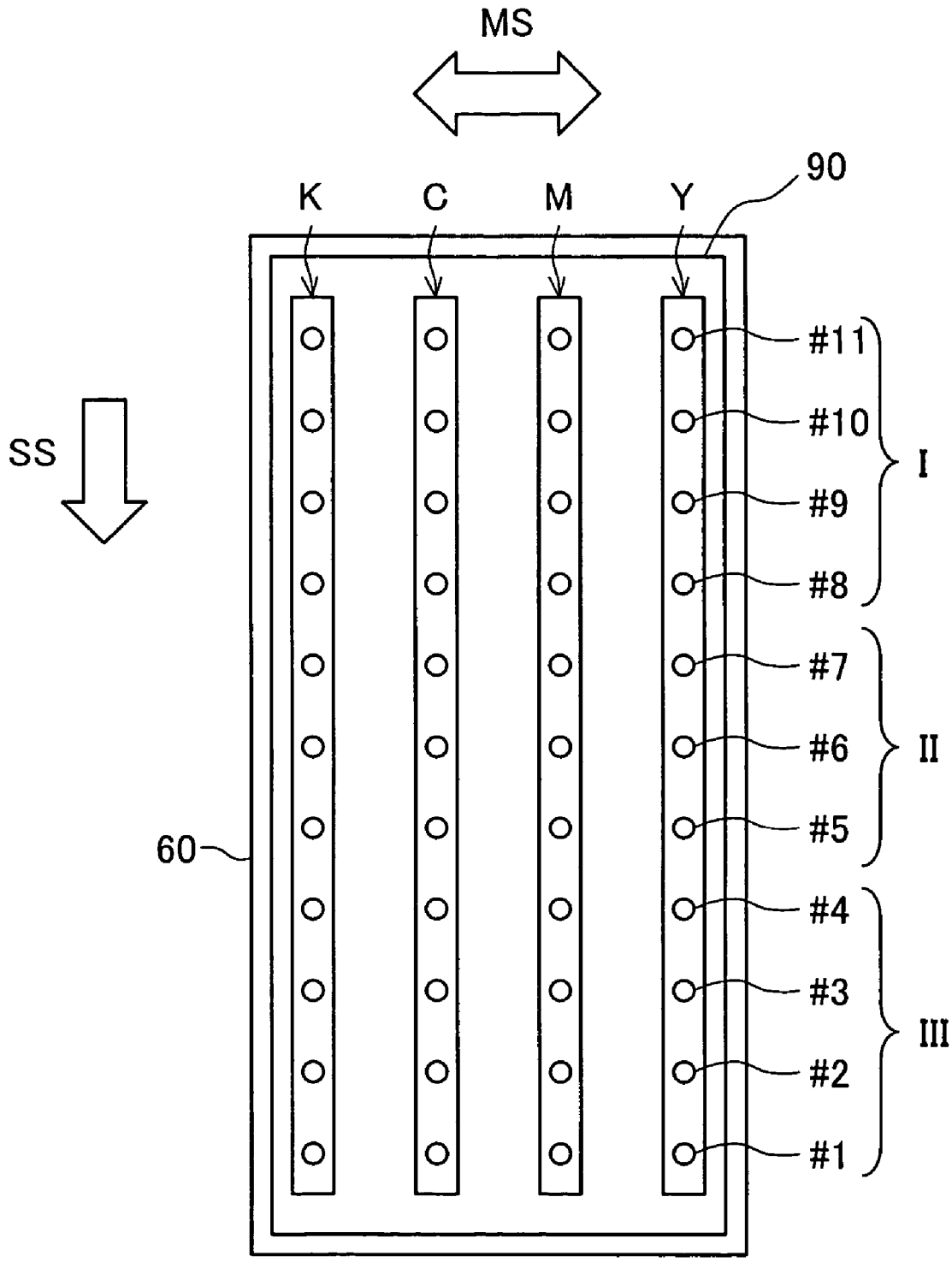
FIG. 3 is an illustrative diagram showing the nozzle arrangement on print head unit 60.

FIG. 3 is an illustrative diagram showing the nozzle arrangement on print head unit 60. Printer 20 is a printing device that prints using inks of four colors, namely, black (K), cyan (C), magenta (M), and yellow (Y). The print head unit 60 is provided with K, C, M and Y nozzle columns arranged in the main scanning direction, with each column containing 11 nozzles arrayed in the sub-scanning direction. Sub-scanning direction nozzle pitch between nozzles in each of the four nozzle columns is equal to 2×D, where D is the main scan line pitch. Each individual nozzle column corresponds to a "plurality of nozzles for ejecting ink droplets of a same given color" recited in the claims. "Main scan line" herein refers to a line of pixels arrayed in the main scanning direction. "Pixel" herein refers to a hypothetical grid square on the print medium, specifying locations for recording dots by depositing ink thereon.

Nozzles in each nozzle column are grouped, in order from the nozzle that first reaches a point over the print medium during a sub-scan, into a first nozzle group, second nozzle group, and third nozzle group arrayed in the sub-scanning direction. In the example shown in FIG. 3, nozzles #8-#11 constitute the first nozzle group I, nozzles #7-#5 constitute the second nozzle group II, and nozzles #1-#4 constitute the third nozzle group III. The third nozzle group and first nozzle group are provided with nozzles extending over ranges that are equal in width in the sub-scanning direction.

The print head unit 60 is reciprocated along the slide rail 34 in the direction of arrow MS by the carriage motor 24. The printing paper P is advanced in the direction of arrow SS relative to the print head 28 by means of the paper feed motor 22.

A2. Printing (1) Image Data Processing

Figure 4:
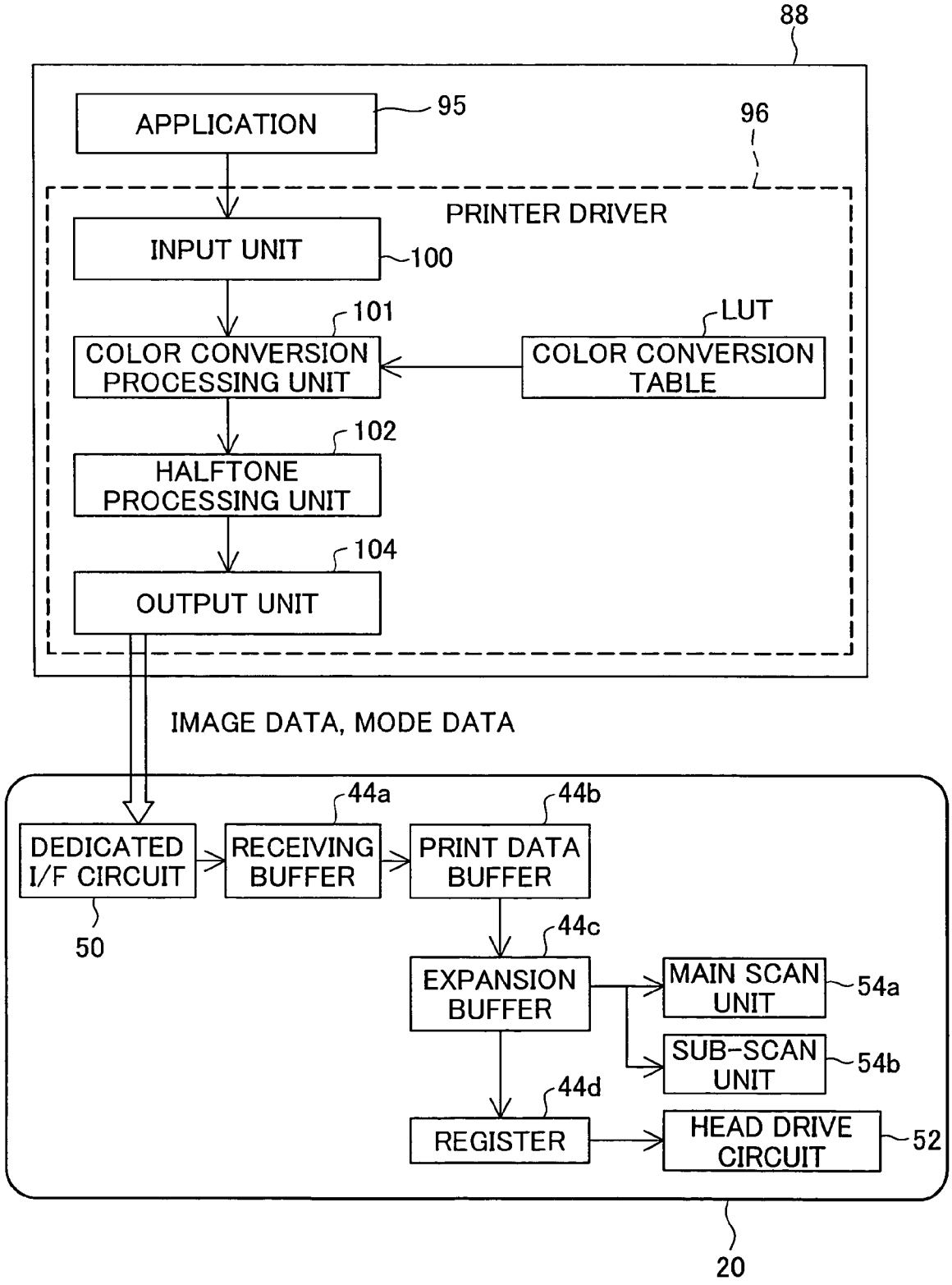
FIG. 4 illustrates functional blocks of computer 88 and printer 20.

FIG. 4 illustrates functional blocks of computer 88 and printer 20. FIG. 2 describes the hardware arrangement; the following description of how the arrangement functions refers to FIG. 4. On computer 88, an application program 95 runs on a predetermined operating system. The operating system includes a printer driver 96. The application program 95 generates image data. The image data is then converted to a format printable by the printer 20.

Printer driver 96 has the following functional units: an input unit 100; a color conversion processing unit 101 and color conversion table LUT; a halftone processing unit 102; and an output unit 104.

When a print command is issued by the application program 95, the input unit 100 receives image data and temporarily stores it. The color conversion processing unit 101 then performs a color conversion process to correct the color components of the image data to color components corresponding to the inks of printer 20. The color conversion process is carried out with reference to the color conversion table LUT, which has pre-stored therein correspondence relationships among color components of image data and color components representable with the inks used by printer 20. The halftone processing unit 102 performs halftone processing on the color-converted data, in order to represent gray level values for each pixel through dot recording density. The converted image data is then output by output unit 104, in single main scan line units in order from the top of the image data, in the form of an output signal PS to the printer 20.

Image data sent from the printer driver 96 is received via the dedicated I/F circuit 50 and placed in RAM 44 (see FIG. 2). This function of RAM 44 is shown in FIG. 4 as receiving buffer 44*a*. RAM 44 also functions as a print data buffer 44*b*, expansion buffer 44*c*, and register 44*d*. These functional units are also shown in FIG. 4.

CPU 41 (see FIG. 2) then generates print data by rearranging the image data stored in the receiving buffer 44*a* in the order in which it will be recorded by printer 20, i.e., in the order of passes made by printer 20. Print data is generated in consideration of which nozzles will be employed during printing. At this time, the CPU 41 also generates data for carriage speed during each pass, the feed distance for sub-scanning performed between passes, and the like, and includes this data in the print data. This function of CPU 41 is shown in FIG. 2 as print data generating unit 41*d*. "Pass" herein refers to a single main scan in which dots are produced. The term "print data" herein refers in a narrow sense to data rearranged into pass order by CPU 41, but in a broader sense refers also to data converted and processed into various forms before or after that.

Subsequently, as shown in FIG. 4, data for a single sequential pass is sent from the print data buffer 44*b* to the expansion buffer 44*c* by CPU 41 (see FIG. 2). This data contains information for forming dots in a single pass for all nozzles used in a single main scan. That is, the data sent to the expansion buffer 44*c* contains data for a plurality of main scan lines on which dots will be recorded in the course of a single main scan. Per-pixel dot forming information for each nozzle is then retrieved from single-pass dot forming information for the nozzles in the forms of blocks in the order in which dots will be produced by the nozzles, and sent to the register 44*d*. That is, parallel dot forming information for pixels lined up in the direction intersecting the main scan lines (i.e. the sub-scanning direction or column direction) is extracted from information for a plurality of main scan lines, and sent to register 44*d*.

CPU 41 then converts the extracted data in register 44*d* into serial data which is sent to the head drive circuit 52. The head drive circuit 52 drives the head according to this serial data to print the image. Data indicating how to do main scan feed and sub-scan feed is also retrieved from the single-pass data in the expansion buffer 44*c*, and is sent to the motor driver circuit 54. FIG. 4 shows, as functional units of the motor driver circuit 54, a main scan unit 54*a* for controlling the carriage motor 24, and a sub-scan unit 54*b* for controlling the paper feed motor 22. The main scan unit 54*a* and sub-scan unit 54*b* perform main scanning and advancing of the printing paper in accordance with the received data.

(2) Deviation in Sizes of Dots By Ink Droplets of the Same Given Weight

Figure 5:
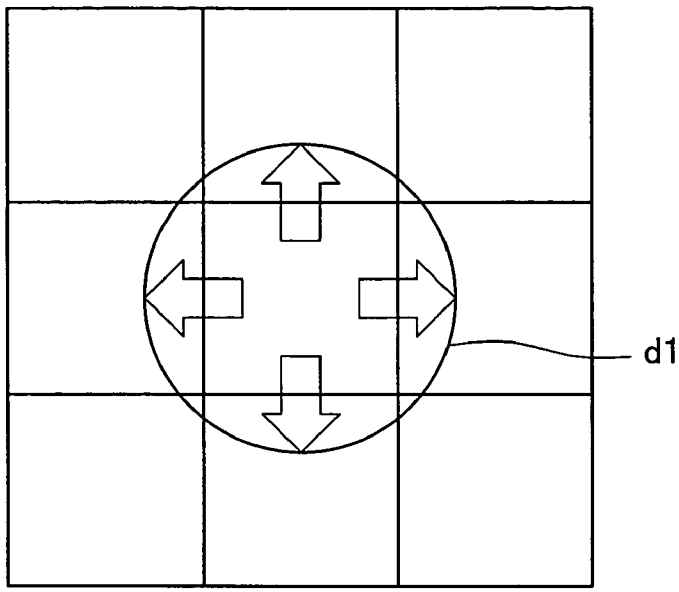
FIG. 5 illustrates dot size produced when a dot d1 is recorded on a pixel whose adjacent surrounding pixels have no dots recorded thereon.
Figure 6:
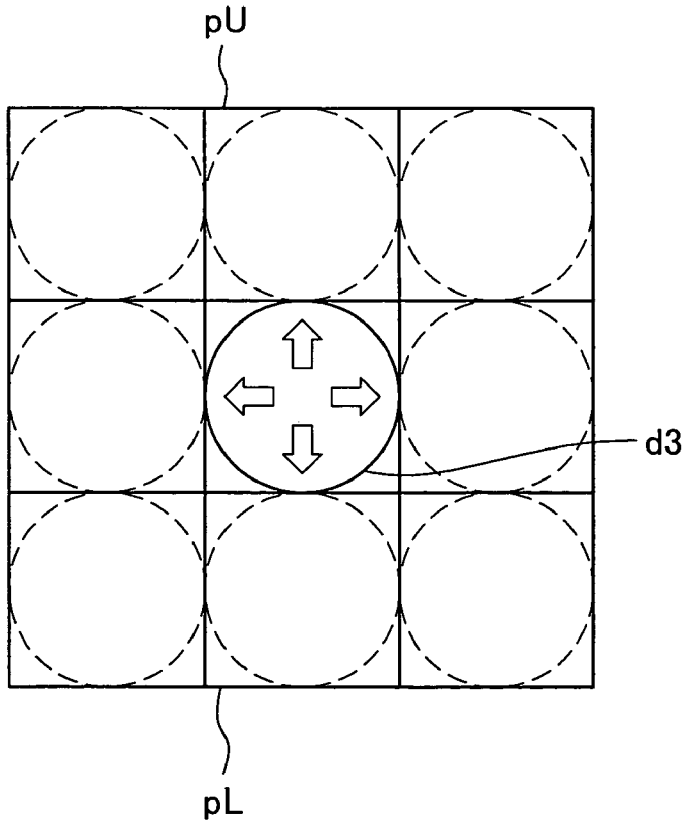
FIG. 6 illustrates dot size produced when a dot d3 is recorded on a center pixel at least some of whose adjacent surrounding pixels, including the two pixels pU, pL situated adjacently to either side in the sub-scanning direction, have dots previously recorded thereon.
Figure 7:
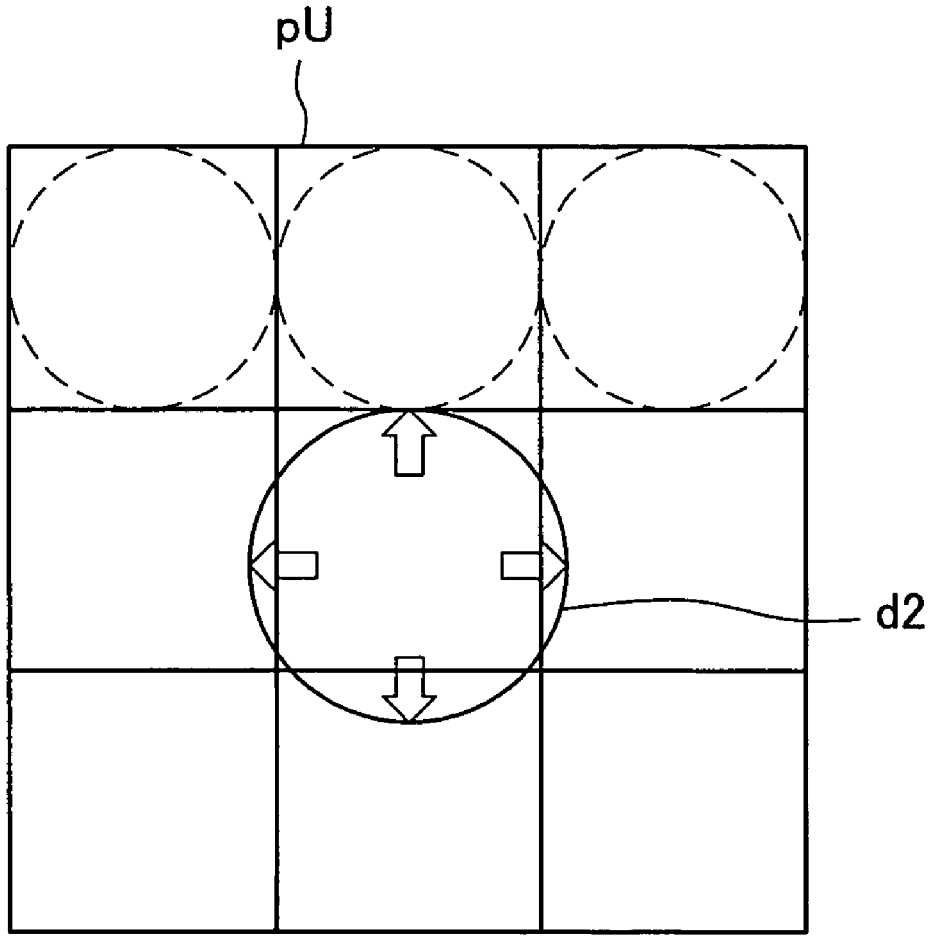
FIG. 7 illustrates dot size produced when a dot d2 is recorded on a pixel at least some of whose adjacent pixels to one side in the sub-scanning direction, including the pixel pU situated adjacently to one side in the sub-scanning direction, have dots previously recorded thereon, with the adjacent surrounding pixels on the other side having no dots recorded thereon.

FIGS. 5 to 7 show difference in dot spread when ink droplets of the same given weight are deposited on pixels. FIG. 5 shows dot size produced when a dot d1 is recorded on a pixel whose adjacent surrounding pixels have no dots recorded thereon. Pixels are represented by squares in a 3×3 grid, with dot size shown by the circle in the center. As shown in FIG. 5, where a dot is recorded on a pixel whose adjacent surrounding pixels have no dots recorded thereon, the ink spreads relatively widely into the surrounding pixels.

FIG. 6 shows dot size produced when a dot d3 is recorded on a center pixel at least some of whose adjacent surrounding pixels, including the two pixels pU, pL situated adjacently to either side in the sub-scanning direction, have dots previously recorded thereon. In FIG. 6, pixels which have the possibilities of having been recorded previously are shown as broken line circles. In this case, ink deposited on the center pixel is obstructed by ink previously recorded in the surrounding pixels, and does not spread out as much as in FIG. 5. Dots represented by broken lines do not mean that all such dots have in fact been previously recorded. The greater the number of the plurality of adjacent pixels having dots recorded thereon, the smaller will be the size of the spread of a dot recorded on the center pixel.

FIG. 7 shows dot size produced when a dot d2 is recorded on a pixel [at least some of whose adjacent] pixels to one side in the sub-scanning direction, including the pixel pU situated adjacently to one side in the sub-scanning direction, have dots previously recorded thereon, with the adjacent surrounding pixels on the other side having no dots recorded thereon. In this case, dot spread will be less than with dot d1 in FIG. 5, but greater than with dot d3 in FIG. 6. As in FIG. 6, dots represented by broken lines do not mean that all such dots have in fact been previously recorded. The greater the number of pixels having recorded thereon dots represented by broken lines, the smaller will be the size of a dot recorded on the center pixel.

(3) Printing

Figure 8:
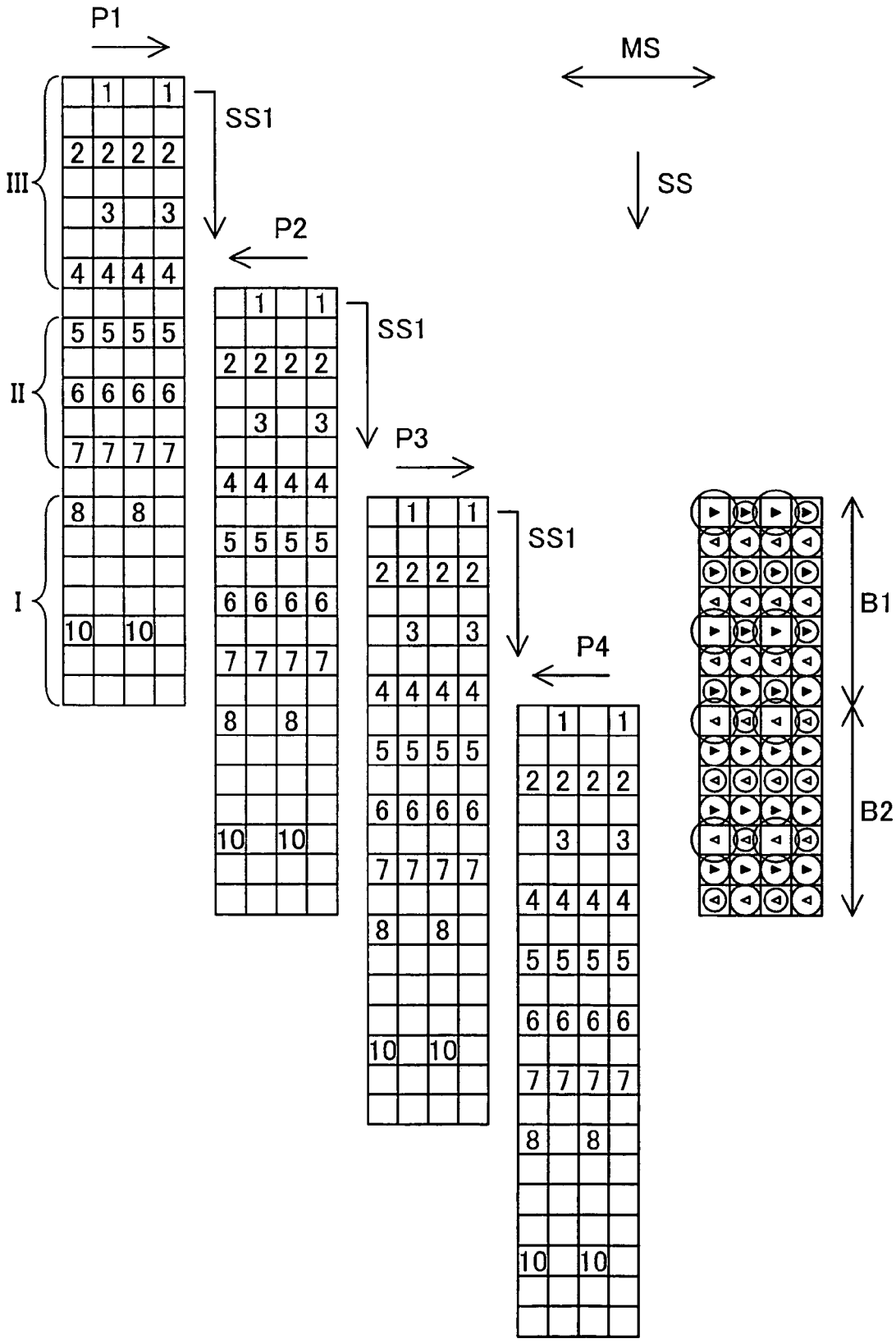
FIG. 8 illustrates the manner in which dot recording is performed in Embodiment 1.

FIG. 8 illustrates the manner in which dot recording is performed in Embodiment 1. To simplify the description, the description shall here focus upon only one column of nozzles selected from the cyan, magenta, yellow and black nozzle columns provided to print head unit 60. In FIG. 8, arrows P1, P2, P3 and P4 each indicate a single main scan. Each rectangle shown below one of the arrows indicates a selected portion (4 columns×21 lines) of the area recorded on the printing paper during that main scan. Here, while only four-column areas are shown, recording in similar fashion is performed repeatedly in the main scanning direction MS during main scans P1–P4.

For example, during main scan P1, every other pixel of the topmost main scan line is recorded by nozzle #1. During main scan P1, dots are recorded by nozzle #2 on all pixels on the third main scan line from the top. Here, "dots are recorded on all pixels" means simply that dots may be recorded on all pixels where necessary. Therefore, in some instances dots may not be recorded on all pixels, depending on the image data to be printed.

Figure 9:
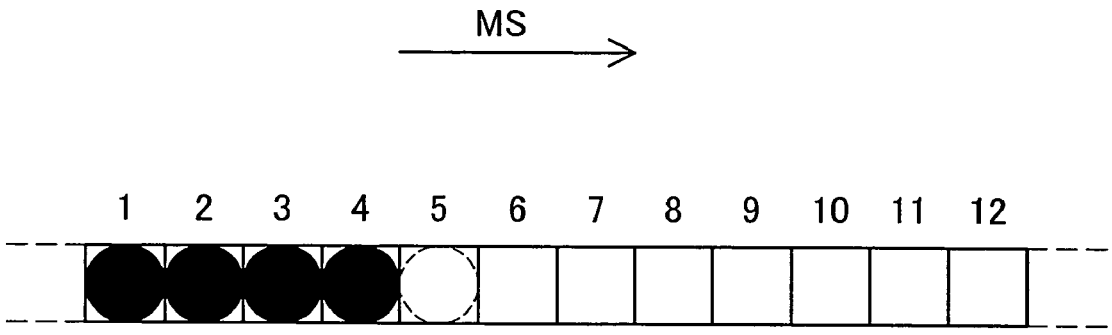
FIG. 9 illustrates the manner in which dots are recorded when dots are recorded on all pixels within a given main scan line using a given nozzle.

FIG. 9 illustrates the manner in which dots are recorded when dots are recorded on all pixels within a given main scan line using a given nozzle. The cells lined up from left to right represent pixels included in a given main scan line. Arrow MS indicates the direction in which the print head unit 60 is advanced. In FIG. 9 and FIGS. 10A–10C, described later, black circles indicated dots recorded previously, while white dots represented by broken lines indicate dots to be recorded subsequently. Where dots are recorded on all pixels within a given main scan line using a given nozzle, as the nozzle passes over each pixel in the course of a main scan, a dot is recorded sequentially on each pixel included in the main scan line. Accordingly, where dots have been recorded previously on pixels up to the fourth pixel from left, a dot will subsequently be recorded on the fifth pixel from left.

Figure 10A:
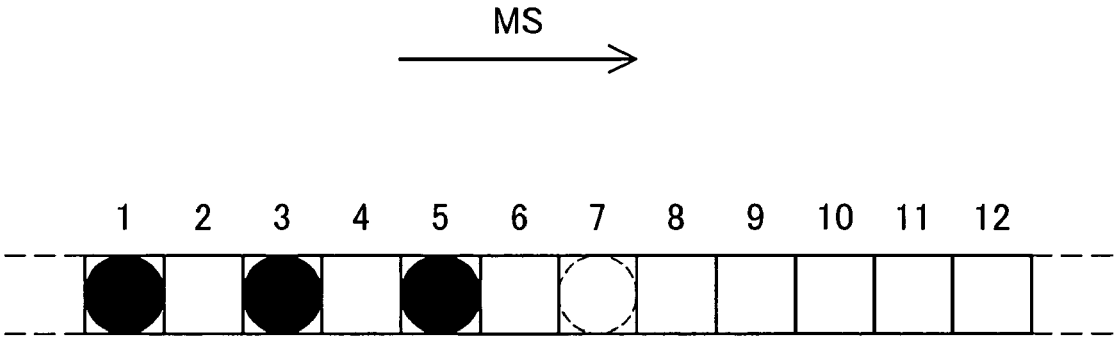
FIGS. 10A to 10C are illustrations of an example of the manner in which dots are recorded when dots are recorded by the first nozzle group on some of the pixels contained in a given main scan line, with pixels not having dots recorded thereon by the first nozzle group having dots recorded thereon using the third nozzle group.
Figure 10B:
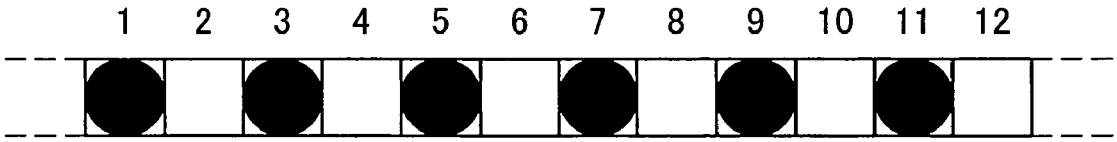
Figure 10C:
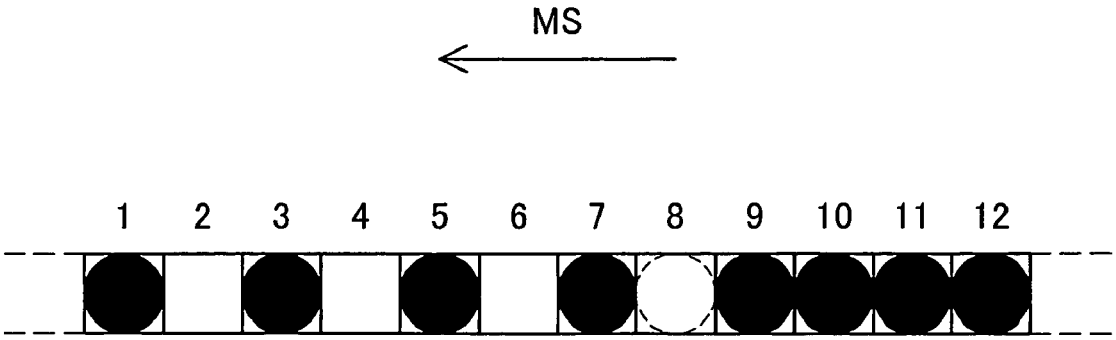

FIGS. 10A–10C show an example of the dot recording in which some of pixels contained in a given main scan line are recorded dots by the first nozzle group, and some of pixels contained in the given main scan line and not having dots recorded thereon are recorded dots by the third nozzle group. As the print head unit 60 is advanced in the direction indicated by arrow MS, the nozzles of the first nozzle group record dots on every other pixel. As shown in FIG. 10A, where dots have been previously recorded on the first, third, and fifth pixels from left, a dot will subsequently be recorded on the seventh pixel from left. Once main scanning in one direction has been completed, pixels will have been recorded on every other dots, as shown in FIG. 10B.

Next, after performing one or more sub-scans, as the print head unit 60 is advanced in the direction of arrow MS during a main scan in the reverse direction from that shown in FIG. 10A, the nozzles of the third nozzle group record dots on every other pixel as shown in FIG. 10C. As shown in FIG. 10C, where dots have been previously recorded on the twelfth and tenth pixels from left, a dot will subsequently be recorded on the eighth pixel from left. Once main scanning in both the forward and reverse directions has been completed, dots will have been recorded on all pixels in the main scan line. CPU 41 generates print data (see FIG. 4) in consideration of whether printing for a given main scan line is performed as shown in FIG. 9, or performed as shown in FIG. 10.

In the dot recording method shown in FIG. 8, during main scan P1 dots are recorded on every other pixel by nozzles #1, #3, #8 and #10 as shown in FIG. 10A. However, it should be noted that where a number is assigned to each pixels in a main scan line (see FIGS. 10A–10C), nozzles #1 and #3 record dots on pixels assigned even numbers, and nozzles #8 and #10 record dots on pixels assigned odd numbers. As shown in FIG. 9, during main scan P1, nozzles #2, and #4-#7 record dots sequentially on each pixel in a main scan line.

Dots are recorded in similar manner during main scans P2, P3, and P4 as well. However, as shown in FIG. 8, while main scan P3 is performed in the same direction as main scan P1, main scans P2 and P4 are performed in the reverse direction. That is, as described in FIGS. 10A–10C, in Embodiment 1 dots are recorded on pixels in the course of main scans in two directions. Between main scans, sub-scans by 7 dots each are performed. Dimensions in the sub-scanning direction are herein given in "dot" units. One dot is the dimension for a single main scan line in the sub-scanning direction.

When an aforementioned sub-scan is performed between main scans, nozzle columns and the printing paper move relative to one another, so that the printing area moves in a seven-dot increment in the sub-scanning direction SS. In FIG. 8, portions of areas recorded during main scans are shown. The seven-dot sub-scans performed between main scans are shown by arrows SS1 connecting the printing areas of the main scans. In actual practice, the printing paper is advanced to change the relative position of the print head unit 60 and the printing paper, but in FIG. 8 the printing areas are shown to move as if the print head unit 60 moves and the printing area moves in association therewith, but this is merely to facilitate description. In FIG. 8 the arrow SS indicating the sub-scanning direction is shown pointing opposite the actual direction of advance of the printing paper, in order to facilitate understanding.

In Embodiment 1, the width of the third nozzle group in the sub-scanning direction is seven dots, as will be apparent from FIG. 8. Feed distance of sub-scan SS1 performed between main scans is preferably a predetermined value approximating the width provided to the third nozzle group in the sub-scanning direction. "Approximating the width provided to the third nozzle group" herein refers to a value from 70% to 130% of the width provided to the third nozzle group. In preferred practice the sub-scan feed distance will be a value from 85% to 115% of the width provided to the third nozzle group, and more preferably a value from 90% to 110% of the width provided to the third nozzle group. By so doing, partial overlap printing can be performed efficiently.

At the right edge in FIG. 8 is shown an exemplary result of recording dots in main scans P1–P4. Here, a 4 column×14 line area has been selected for illustration. The cells indicate pixels. The circles representing dots are shown as circles of three different sizes. Dots which are recorded on pixels whose adjacent surrounding pixels have no dots recorded thereon, as shown in FIG. 5, are depicted as circles of size projecting out beyond the cell representing the pixel. Dots which are recorded on pixels whose two adjacent pixels situated to either side in the sub-scanning direction have dots previously recorded thereon, as shown in FIG. 6, are depicted as circles of size not contacting the pixel cell. Dots which are recorded on pixels at least one of whose adjacent surrounding pixels has a dot previously recorded thereon, as shown in FIG. 7, are depicted as circles of size contacting the pixel cell.

The triangles in the pixels indicate main scanning direction. Pixels containing black, rightward pointing triangles have dots recorded thereon during rightward main scanning. Pixels containing white, leftward pointing triangles have dots recorded thereon during leftward main scanning.

When dots are recorded in the preceding manner, the particular combination of the nozzles employed to record dots on each pixel and the order in which these dots are recorded on pixels is repeated over predetermined width in the sub-scanning direction. The width of this repeating unit is seven dots. In the example of FIG. 8, recording as shown in area B1 and recording as shown in area B2 repeat in alternating fashion. That is, where a given area has been printed with a single color, the texture of area B1 and the texture of area B2 will repeat.

Pixels in ranges B1 and B2 all contain circles denoting dots. However, in actual practice, it is rare for dots to be recorded on all pixels. To simplify the description, it is here presumed that dots are recorded on all pixels, and circles are appended to all pixels. The circles appended to the pixels merely indicate the possibility of recording dots thereon in response to image data, and are intended to show how, when dots are recorded, the size of recorded dots differs by pixel. The circles are not intended to mean that dots are actually recorded.

In the example of FIG. 8, the point in time that main scans P1 and P2 are performed is a point in time coming just after printing has commenced, whereas the period main scan P3 and subsequent scans take place is the stationary state. Accordingly, the following description of recording of dots by each nozzle group will take the example of main scan P3. During main scan P3, nozzle #8 and nozzle #10, which belong to the first nozzle group, record dots on certain pixels among the pixels included in main scan lines positioned facing these nozzles. Recording of these dots corresponds to the "first partial line recording" recited in the claims.

During main scan P3, nozzles #4–#7, which belong to the second nozzle group, record dots on all pixels among the pixels included in main scan lines positioned facing these nozzles. Recording of these dots corresponds to the "entire line recording" recited in the claims.

During main scan P3, nozzles #1–#4, which belong to the third nozzle group, record dots on those pixels among pixels contained in main scan lines positioned facing these, and that have not previously had dots recorded thereon by the first nozzle group. For example, nozzle #2 and nozzle #4 record dots on main scan lines which have not previously had dots recorded thereon by nozzles of the first nozzle group. Nozzle #1 and nozzle #3, on the other hand, record dots on main scan lines which have previously had dots recorded thereon by nozzle #8 and nozzle #10 of the first nozzle group during main scan P1. However, whereas the pixels having dots recorded thereon by nozzle #8 and nozzle #10 of the first nozzle group during main scan P1 are odd-numbered, the pixels onto which dots are recorded by nozzle #1 and nozzle #3 are even-numbered. Thus, nozzles #1-#4 of the third nozzle group record dots on pixels which have not yet had dots recorded thereon by the first nozzle group in previous main scans. Recording of these dots corresponds to the "second partial line recording" recited in the claims.

Nozzles #2, #4 of the third nozzle group record dots on all pixels contained in main scan lines positioned facing these. However, nozzles #1, #3 of the same third nozzle group do not record dots on all pixels contained in main scan lines positioned facing these. In this case as well, where the third nozzle group taken as a whole, dots are not recorded on all pixels in main scan lines positioned facing all of the nozzles of the nozzle group. Thus, this case also corresponds to one of "certain pixels among pixels contained in main scan lines positioned facing the nozzles of the nozzle group being targeted for dot recording." In the present embodiment, dots are not recorded on all pixels of main scan lines positioned facing certain nozzles of the first nozzle group. However, in the present embodiment, even if dots were recorded on all pixels of main scan lines positioned facing certain nozzles of the first nozzle group, where dots are not recorded on all pixels of main scan lines positioned facing certain other nozzles, this case will correspond to one of "certain pixels among pixels contained in main scan lines positioned facing the nozzles of the nozzle group being targeted for dot recording."

By executing the program stored in P-ROM 43, CPU 41 performs first partial line recording, entire line recording, and second partial line recording as described above. As functional units of CPU 41, FIG. 2 shows a first partial line recording unit 41*a*, an entire line recording unit 41*b*, and a second partial line recording unit 41*c*.

The following description relates not only to a specific main scan, but to all main scans, and will therefore take the example of main scan P1 shown in FIG. 8. In FIG. 8, "I" designates the area recorded by the first nozzle group during main scan P1; "II" designates the area recorded by the second nozzle group; and "III" designates the area recorded by the third nozzle group. In FIG. 8, within the rectangular area depicting a portion of the area recorded in main scan P1, four pixels are recorded by nozzles #8 and #10 of the first nozzle group. The number of pixels from end to end of a single main scan line is designated AP (AP is a positive integer). Since areas for main scans shown in FIG. 8 contain four columns, the number N1 of pixels recorded by nozzles of the first nozzle group during main scan P1 is (4×AP/4), i.e., AP.

Similarly, within the rectangular area depicting a portion of the area recorded in main scan P1, the number of pixels recorded by nozzles #1–#4 of the third nozzle group during main scan P1 is 12. Thus, the number N3 of pixels recorded by nozzles of the first nozzle group during main scan P1 is (12×AP/4), i.e. (AP×3). The number N1 of pixels recorded by nozzles of the first nozzle group and number N3 of pixels recorded by nozzles of the third nozzle group will be the same as those above in other main scans as well. In other words, the ratio of the number N1 of pixels recorded by nozzles of the first nozzle group to the number N3 of pixels recorded by nozzles of the third nozzle group in main scans is 1:3.

The sub-scanning direction width of the first nozzle group and third nozzle group is specified as follows. When specifying the width of the first nozzle group and third nozzle group, the nozzle group that records the fewest pixels during main scans is selected as a standard from among the first nozzle group and third nozzle group. Hereinafter, the nozzle group selected as the standard shall be termed the "standard nozzle group". A first standard nozzle, which specifies a first end of the standard nozzle group in the sub-scanning direction, is designated by selecting from among all of the nozzles a nozzle located at a sub-scanning direction end. If the standard nozzle group is the first nozzle group, the first standard nozzles will be the nozzles which first reach the print medium during sub-scanning. If the standard nozzle group is the third nozzle group, the first standard nozzles will be the nozzles which last reach the print medium during sub-scanning.

With the first standard nozzles as the start point, when nozzles were examined in sequence going towards the center of the first to third nozzle groups in the sub-scanning direction, the first nozzles to appear that meet the following conditions are the end nozzles of the second nozzle group. The nozzles just before these are second standard nozzles specifying the second end of the standard nozzle group. This condition is that the nozzles are "the nozzles that have as target for dot recording all pixels contained in the main scan line positioned facing them during main scanning." In this way, the first standard nozzles and second standard nozzles of the standard nozzle group are specified.

The area extending from the first standard nozzles to the second standard nozzles in the sub-scanning direction is the sub-scanning direction area provided to the standard nozzle group. The sub-scanning direction distance from the first standard nozzles to the second standard nozzles is the sub-scanning direction width provided to the standard nozzle group. With regard to the first nozzle group and third nozzle group, the width of the nozzle group that is not designated as the standard nozzle group will be a value equal to the width of the standard nozzle group.

(4) Determination of Printing Method

The ratio of the number N1 of pixels recorded by nozzles of the first nozzle group to the number N3 of pixels recorded by nozzles of the third nozzle group is selected so as to give high print quality. The following description pertains to the manner of determining this ratio of the number N1 of pixels, which are recorded by nozzles of the first nozzle group, to the number N3 of pixels, which are recorded by nozzles of the third nozzle group.

When determining the ratio of N1 to N3, in actual practice this may be accomplished by performing printing a number of times while varying the values for N1 and N3. Where this approach is employed, the printing method that in actual practice gives the highest print quality can be selected. In particular, where printed images have given tendencies, such as where a majority of images to be printed use the specific kind of colors more, establishing N1 and N3 on the basis of actual printed results enables selection of settings that are suitable for printing such images.

Figure 11:
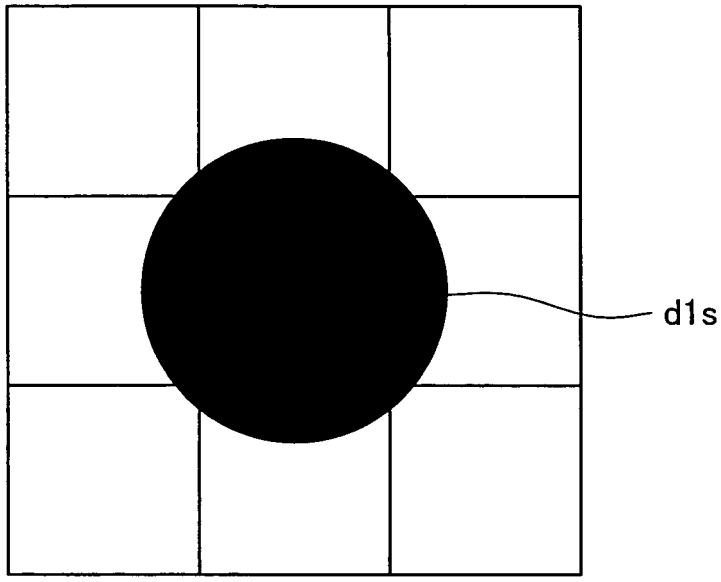
FIG. 11 illustrates a dot d1*s* produced when a dot is recorded on a pixel whose adjacent surrounding pixels do not have dots recorded thereon.
Figure 12:
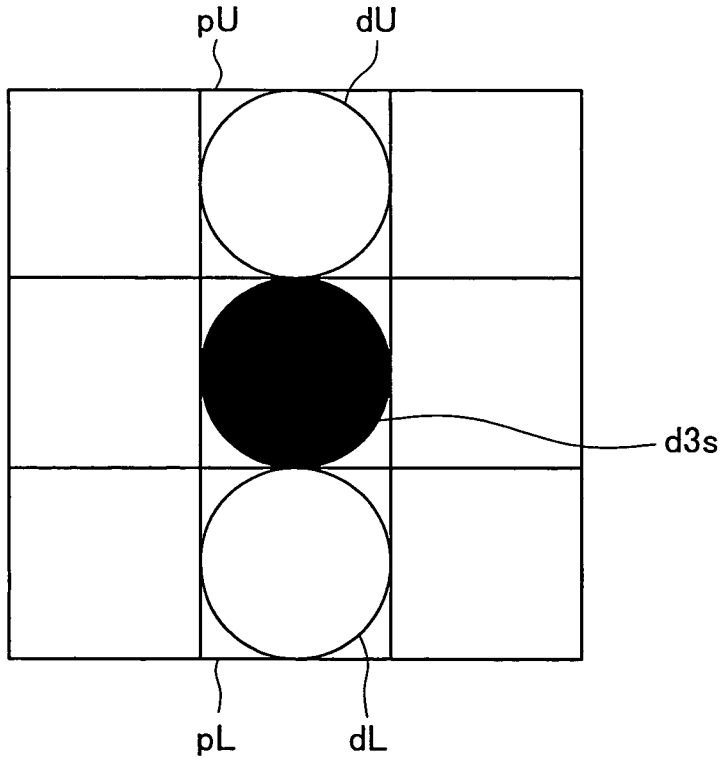
FIG. 12 illustrates a dot d3*s* produced when a dot is recorded on a medial pixel whose two adjacent pixels pU, pL situated to either side thereof in the sub-scanning direction have dots dU, dL recorded thereon.
Figure 13:
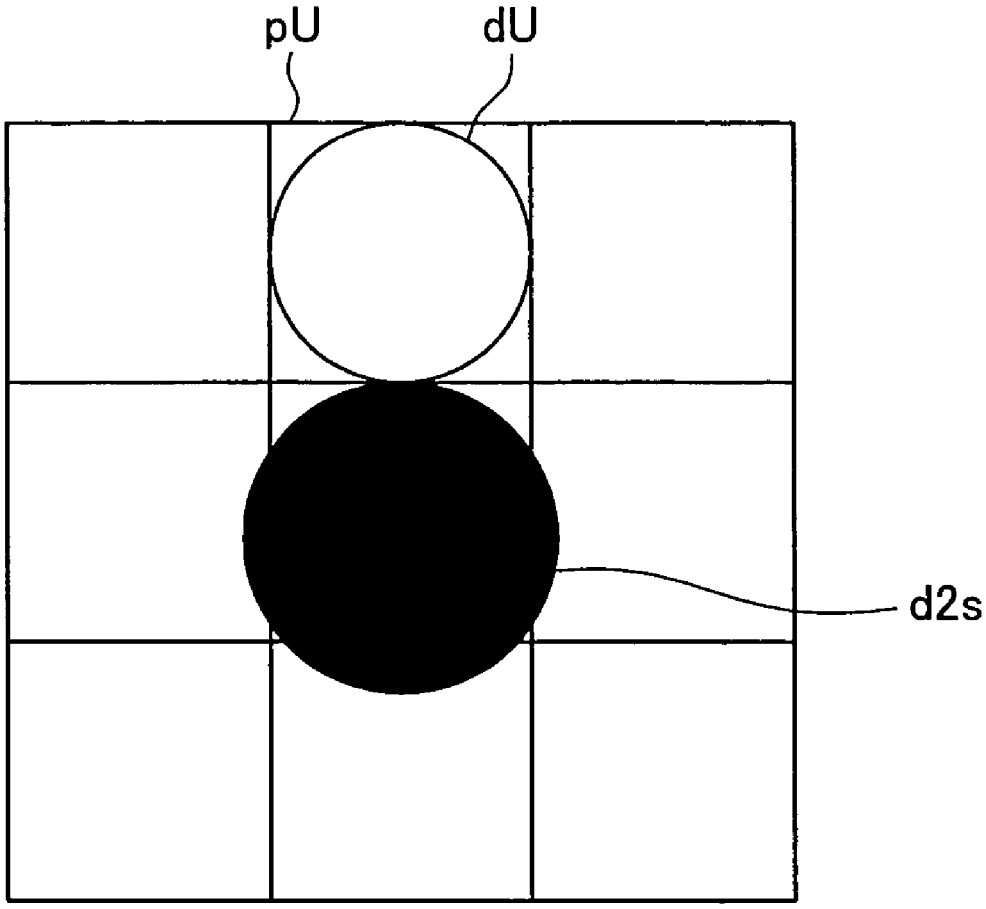
FIG. 13 illustrates a dot produced when a dot d2*s* is recorded on a center pixel one of whose adjacent pixel pU to one side thereof in the sub-scanning direction has a dot dU recorded thereon, with the adjacent surrounding pixel on the other side thereof having no dot recorded thereon.

FIG. 11 shows a dot d1*s* produced when a dot is recorded on a pixel whose adjacent surrounding pixels do not have dots recorded thereon. FIG. 12 shows a dot d3*s* produced when a dot is recorded on a medial pixel whose two adjacent pixels pU, pL situated to either side thereof in the sub-scanning direction have dots dU, dL recorded thereon. FIG. 13 shows a dot produced when a dot d2*s* is recorded on a center pixel one of whose adjacent pixels pU to one side thereof in the sub-scanning direction has a dot dU recorded thereon, with the adjacent surrounding pixel on the other side thereof having no dot recorded thereon. The weight of the ink ejected to form dots d1*s*–d3*s*, dU, and dL is the same in each case.

When determining the number N1 of pixels recorded by nozzles of the first nozzle group and the number N3 of pixels recorded by nozzles of the third nozzle group, dots d1*s*–d3*s* are produced on the printing paper as shown in FIGS. 11–13. The dots produced in this manner are then photographed with a CCD camera, and areas W1, W2, W3 of the dots d1*s*, d2*s*, d3*s* are calculated. In the present embodiment, where the area W2 of dot d2*s* is assigned a value of 100, the area W1 of dot d1*s* is 160, and the area W3 of dot d3*s* is 80, for example.

The area W3 of dot d3*s* shown in FIG. 12 is calculated as follows. Dots dU and dL are initially recorded onto printing paper, and these are then photographed with a CCD camera, and the areas of dots dU and dL calculated. Dot d3*s* is then recorded, dots dU, dL, and d3*s* are re-photographed with a CCD camera, and the total area of dots dU, dL, and d3*s* is calculated. The previously calculated areas for dots dU and dL are then subtracted from the total area of dots dU, dL, and d3*s*, to arrive at area W3 for dot d3*s*. A similar procedure is used for dot d2*s* shown in FIG. 13 as well.

Dot d1*s* in FIG. 11 is representative of a dot recorded on a pixel whose adjacent surrounding pixels do not have dots recorded thereon like dot d1 in FIG. 5. Dot d3*s* in FIG. 12 is representative of a dot recorded on a pixel whose adjacent surrounding pixels have dots previously recorded thereon like dot d3 in FIG. 6. In the case of dot d3 in FIG. 6, surrounding dots shown by broken line circles are present in possibility, but in actual practice may be recorded or not recorded, as the case may be. In contrast, in the case of recording dot d3*s* of FIG. 12, of the dots which are present in possibility, dots dU and dL have actually been recorded at the time that dot d3*s* is recorded. The area W3 of dot d3*s* is calculated as a standard area for dot d3 of FIG. 6. A similar relationship exists between dot d2 of FIG. 7 and dot d2*s* of FIG. 13.

The number N1 of pixels recorded by nozzles of the first nozzle group and the number N3 of pixels recorded by nozzles of the third nozzle group can be determined on the basis of areas W1, W2, W3 of dots D1*s*, d2*s*, d3*s* calculated in the above-described manner. Specifically, N1 and N3 are determined such that the value of W13, given by Equation (2) below, approximates the value of W2.

$$W13=\{W1\times N1/(N1+N3)\}+\{W3\times N3/(N1+N3)\} \quad (2)$$

Here, "W13 approximates the value of W2" means that the value of W13 is from 70% to 130% of the value of W2. In preferred practice, N1 and N3 are determined such that the value of W13 is from 85% to 115% of the value of W2, and more preferably N1 and N3 are determined such that the value of W13 is from 90% to 110% of the value of W2.

As noted, since W1 was 160 and W3 was 80, Equation (2) is given as:

$$W13=(160\times N1+80\times N3)/(N1+N3) \quad (3)$$

For W13 to equal W2, i.e. to equal 100, N1 and N3 will fulfill the following relationship.

$$N1:N3=1:3 \quad (4)$$

In the printing method shown in FIG. 8, the ratio of the number N1 of pixels recorded by nozzles of the first nozzle group to the number N3 of pixels recorded by nozzles of the third nozzle group is determined in the above manner.

Of the first to third nozzle groups, the first nozzle group is the first to reach the main scan lines on the print medium. Additionally, nozzle pitch is 2, and dots are not recorded simultaneously on neighboring main scan lines. Thus, ink droplets ejected by nozzles of the first nozzle group are highly likely to be deposited on pixels whose adjacent surrounding pixels have no dots recorded thereon. Therefore, it is highly likely that dots produced by nozzles of the first nozzle group will have the size of dot d1*s* shown in FIG. 11.

Of the first to third nozzle groups, the third nozzle group is the last to reach the main scan lines on the print medium. Thus, ink droplets ejected by nozzles of the third nozzle group are highly likely to be deposited on pixels whose two adjacent pixels to either side thereof in the sub-scanning direction have dots recorded thereon. Therefore, it is highly likely that dots produced by nozzles of the third nozzle group will have the size of dot d3*s* shown in FIG. 12.

The second nozzle group reaches main scan lines on the print medium after the first nozzle group and before the third nozzle group. Thus, ink droplets ejected by nozzles of the second nozzle group are highly likely to be deposited on pixels whose adjacent pixel to one side thereof in the sub-scanning direction has a dot recorded thereon, with the adjacent pixel on the other side thereof having no dot recorded thereon. Therefore, it is highly likely that dots produced by nozzles of the second nozzle group will have the size of dot d2*s* shown in FIG. 13.

In the present embodiment, among pixels recorded on main scan lines by nozzles of the first nozzle group and nozzles of the third nozzle group, the ratio of dots produced by the first nozzle group and dots produced by the third nozzle group is determined on the basis of Equation (2). W13 obtained from Equation (2) is the expected value of dots in pixels of main scan line groups recorded by nozzles of the first nozzle group and nozzles of the third nozzle group. In the present embodiment, the ratio (presence ratio) of dots produced by the first nozzle group and dots produced by the third nozzle group is determined such that the expected value of dots in pixels of main scan line groups recorded by nozzles of the first nozzle group and nozzles of the third nozzle group approximates the value of W2. Accordingly, there will be few readily apparent differences between areas recorded by nozzles of the first nozzle group and nozzles of the third nozzle group on the one hand, and areas recorded by nozzles of the second nozzle group on the other. Thus, there will be few readily apparent differences between texture in area B1 and texture in area B2 (see FIG. 8). As a result, print quality is high. This advantage may be achieved by determining suitable respective values for the numbers N1 and N3 per se, or by determining a suitable value for the ratio of N1 to N3.

As shown in FIG. 3, in the present embodiment nozzle columns of each color are arrayed lined up in the main scanning direction MS. Thus, in the event of overstrike by ink droplets of two or more colors on a single pixel, the order in which inks are deposited will differ depending on the direction of main scanning. For example, where a cyan (C) ink droplet and a yellow (Y) ink droplet are overstruck onto a single pixel, depending on whether recording takes place in a main scan forward pass or recording takes place in a reverse pass, either the cyan ink droplet will be deposited first on the printing paper, or the yellow ink droplet will be deposited first on the printing paper. As a result, color may vary slightly event where droplets of identical amounts of ink are ejected.

In the present embodiment, the problem of color variation due to different order of ink overstrike in bidirectional printing may not be eliminated. However, a problem of degraded image quality, due to difference in spread by the ink deposited first, also exists even among pixels onto which have been deposited ink droplets of identical type and weight, in the same order of overstrike. By carrying out printing in the manner of the present embodiment, degraded image quality due to differences in ink spread can be minimized. Thus, by carrying out printing in the manner of the present embodiment, the quality of the printed result can be improved, even in cases where overstrike recording of inks of several colors is necessary.

Figure 14:
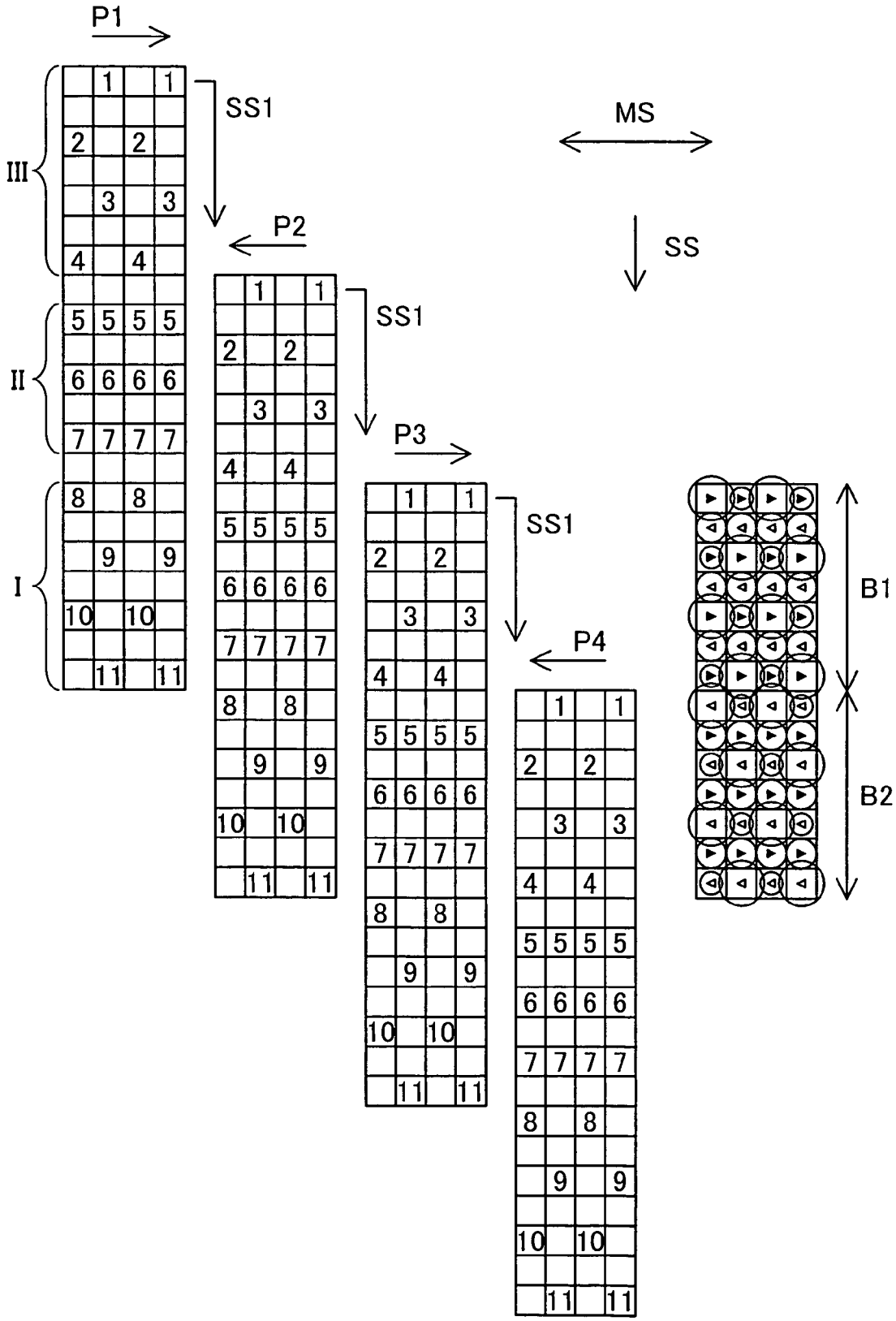
FIG. 14 illustrates the manner in which dot recording is performed in a comparative example.

FIG. 14 illustrates the manner in which dot recording is performed in a comparative example. In the dot recording method of the comparative example, on main scan lines nozzles #1, #3, #9 and #11 record dots onto pixels assigned even numbers in main scan lines facing them. Nozzles #2, #4, #8 and #10 record dots onto pixels assigned odd numbers in main scan lines facing them. In main scan lines, nozzles #5-#7 sequentially record dots onto each pixel in the main scan line.

In FIG. 14, within the rectangular area depicting a portion of the area recorded in main scan P1, eight pixels are recorded by nozzles #8 and #11 of the first nozzle group. Thus, the number N1' of pixels recorded by nozzles of the first nozzle group during a single main scan is (8×AP/4), i.e., (AP×2).

Similarly, within the rectangular area depicting a portion of the area recorded in main scan P1, eight pixels are recorded by nozzles #1-#4 of the third nozzle group. Thus, the number N3' of pixels recorded by nozzles of the third nozzle group during a single main scan is also (AP×2). That is, the ratio of the number N1' of pixels recorded by nozzles of the first nozzle group to the number N3' of pixels recorded by nozzles of the third nozzle group is 1:1.

With such an arrangement, the expected value W13' of dots in pixels of main scan line groups recorded by nozzles of the first nozzle group and nozzles of the third nozzle group is 120, from Equation (2). That is, there is a larger difference relative to W2 than exists with expected value of 100 for W13 in the example of FIG. 8. Therefore, differences between areas recorded by nozzles of the first nozzle group and nozzles of the third nozzle group on the one hand, and areas recorded by nozzles of the second nozzle group on the other, will be more apparent than in FIG. 8. Thus, readily apparent differences between texture in area B1 and texture in area B2 (see FIG. 14), and print quality will be lower than in FIG. 8.

B. Embodiment 2

In Embodiment 1, nozzles of the second nozzle group record dots onto all pixels of main scan lines positioned facing, in the course of a single main scan. In Embodiment 2, however, nozzles of the second nozzle group record dots onto all pixels of main scan lines positioned facing, in the course of several main scans. The hardware arrangement of the printing device of Embodiment 2 is the same as that of the printing device of Embodiment 1.

Figure 15:
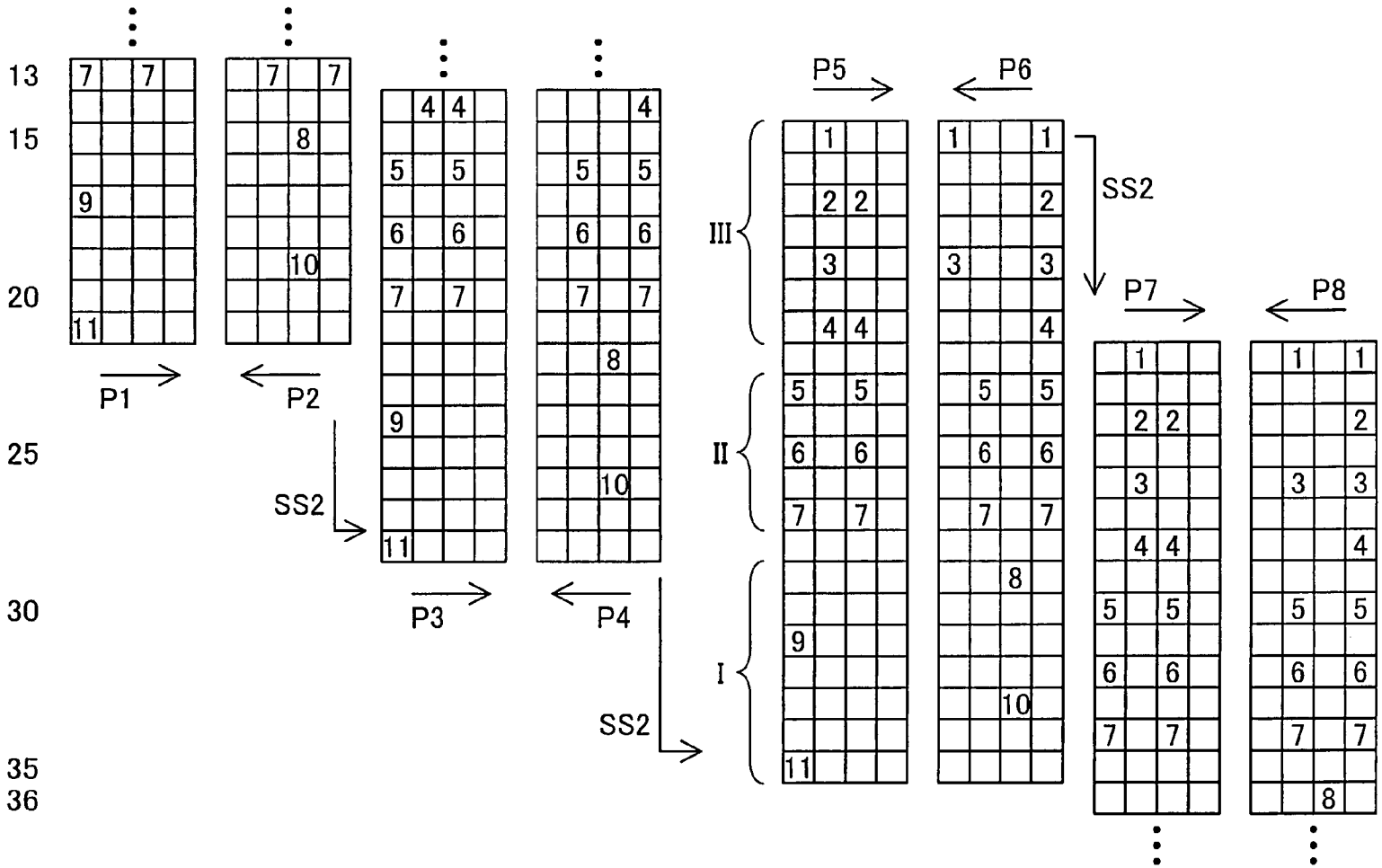
FIG. 15 illustrates the manner in which dot recording is performed in Embodiment 2.

FIG. 15 illustrates the manner in which dot recording is performed in Embodiment 2. Numbers for main scan lines are shown at left in the drawing. In FIG. 15, lines 13 to 36 are shown. The four columns of pixels shown for each of main scans P1–P8 correspond respectively, in order from the left, to pixels with numbers leaving a remainder of 1 when divided by 4, pixels with numbers leaving a remainder of 2 when divided by 4, pixels with numbers leaving a remainder of 3 when divided by 4, and pixels with numbers divisible by 4 with no remainder (see FIGS. 9 and 10). As shown in FIG. 15, in Embodiment 2, sub-scanning SS2 by a feed distance of 7 dots is performed once for each two (i.e. a forward and a reverse pass) main scans. That is, for a given position in the sub-scanning direction, two (i.e. a forward and a reverse) main scans are performed.

During a main scan forward pass, nozzles #5-#7 of the second nozzle group record dots onto odd-numbered pixels in the same manner as in the example shown in FIG. 10A. During a main scan reverse pass, dots onto even-numbered pixels in the same manner as in the example shown in FIG. 10C. As a result, in the course of the two forward and reverse main scans, dots are recorded onto all pixels in main scan lines positioned facing the nozzles. For example, in FIG. 15, lines 16, 18, and 20 are recorded by the above recording method during main scans P3 and P4.

During a main scan forward pass, nozzle #9 and nozzle #11 of the first nozzle group record dots onto pixels with numbers leaving a remainder of 1 when divided by 4. Dots are not recorded during the main scan reverse pass. As a result, of pixels contained in main scan lines positioned facing these nozzles, dots are recorded only onto pixels with numbers leaving a remainder of 1 when divided by 4 in the course of the two forward and reverse main scans. For example, in FIG. 15, lines 17 and 21 are recorded by the above recording method during main scans P1 and P2.

Nozzle #8 and nozzle #10 of the first nozzle group do not record dots during the main scan forward pass. In the subsequent main scan reverse pass, they record dots onto pixels with numbers leaving a remainder of 3 when divided by 4. As a result, of pixels contained in main scan lines positioned facing these nozzles, dots are recorded only onto pixels with numbers leaving a remainder of 3 when divided by 4, in the course of the two forward and reverse main scans. For example, in FIG. 15, lines 15 and 19 are recorded by the above recording method during main scans P1 and P2.

Nozzle #1 and nozzle #3 of the third nozzle group record dots onto pixels with numbers leaving a remainder of 2 when divided by 4 during the main scan forward pass. In the subsequent main scan reverse pass, they record dots onto pixels with numbers leaving a remainder of 1 when divided by 4, and pixels with numbers divisible by 4 with no remainder. As a result, of pixels contained in main scan lines positioned facing these nozzles, dots are recorded onto pixels with numbers leaving a remainder of 1 when divided by 4, pixels with numbers leaving a remainder of 2 when divided by 4, and pixels with numbers leaving a remainder of 3 when divided by 4, in the course of the two forward and reverse main scans. For example, in FIG. 15, lines 15 and 19 are recorded by the above recording method during main scans P5 and P6.

Pixels having dots recorded thereon by nozzle #1 of the third nozzle group are pixels that have not had dots recorded thereon by nozzle #8 of the first nozzle group in previous main scans. For example, in line 15, dots are recorded onto pixels with numbers leaving a remainder of 3 when divided by 4, by nozzle #8 during main scan P2. Subsequently, dots are formed on the remaining pixels by nozzle #1 in main scans P5 and P6. As a result, dots are recorded onto all pixels. A similar relationship exists between nozzle #3 of the third nozzle group and nozzle #10 of the first nozzle group.

During a main scan forward pass, nozzle #2 and nozzle #4 of the third nozzle group record dots onto pixels with numbers leaving a remainder of 2 when divided by 4, and pixels with numbers leaving a remainder of 3 when divided by 4. During the subsequent main scan reverse pass, dots are recorded onto pixels with numbers divisible by 4 with no remainder. For example, in FIG. 15, lines 17 and 21 are recorded by the above recording method during main scans P5 and P6.

Pixels having dots recorded thereon by nozzle #2 of the third nozzle group are pixels that have not had dots recorded thereon by nozzle #9 of the first nozzle group in previous main scans. For example, in line 17, dots are recorded onto pixels with numbers leaving a remainder of 1 when divided by 4, by nozzle #9 during main scan P1; subsequently, dots are formed on the remaining pixels by nozzle #2 in main scans P5 and P6. As a result, dots are recorded onto all pixels. A similar relationship exists between nozzle #4 of the third nozzle group and nozzle #11 of the first nozzle group.

FIGS. 16A–D show an example of the manner in which dots are recorded, where dots are recorded by nozzle #9 of the first nozzle group onto certain pixels of the pixels included in line 17 of FIG. 15, and dots then recorded by nozzle #2 of the third nozzle group onto those pixels not having dots recorded thereon by the first nozzle group. The direction of main scanning is indicated in each drawing by an arrow. Dots recorded prior to the current main scan are indicated by white circles, and dots recorded during the current main scan are indicated by black circles.

Figure 16A:
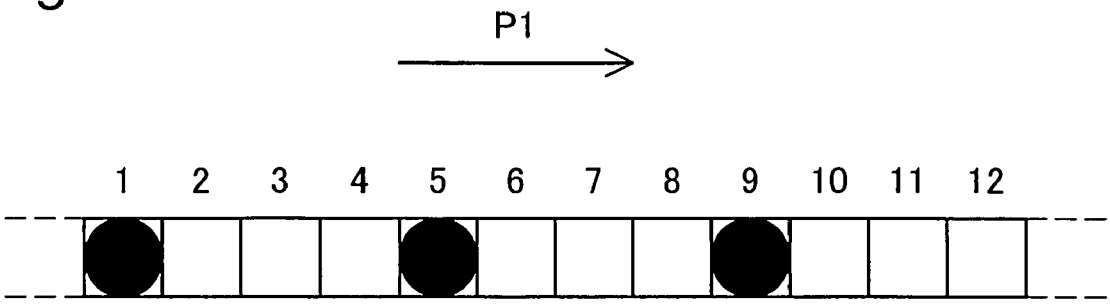
FIGS. 16A to 16D illustrate an example of the manner in which dots are recorded, where dots are recorded by a nozzle of the first nozzle group onto certain pixels of the pixels included in line 17, and dots then recorded by a nozzle of the third nozzle group onto those pixels not having dots recorded thereon by the first nozzle group.
Figure 16B:
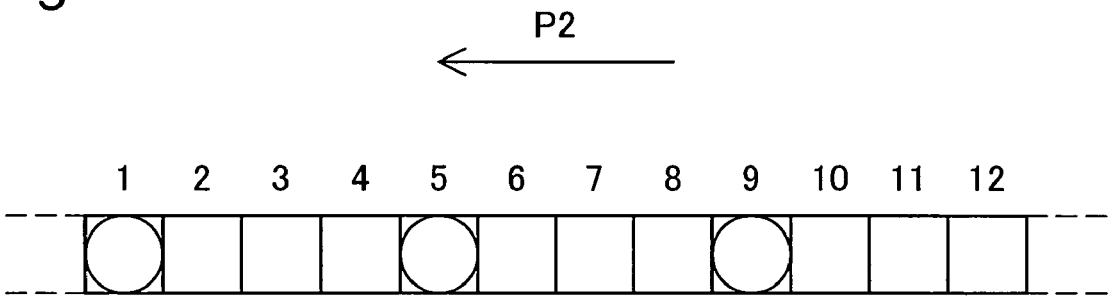
Figure 16C:
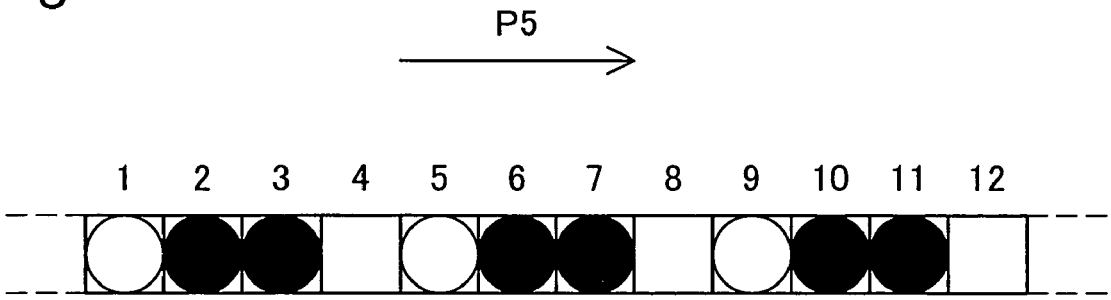
Figure 16D:
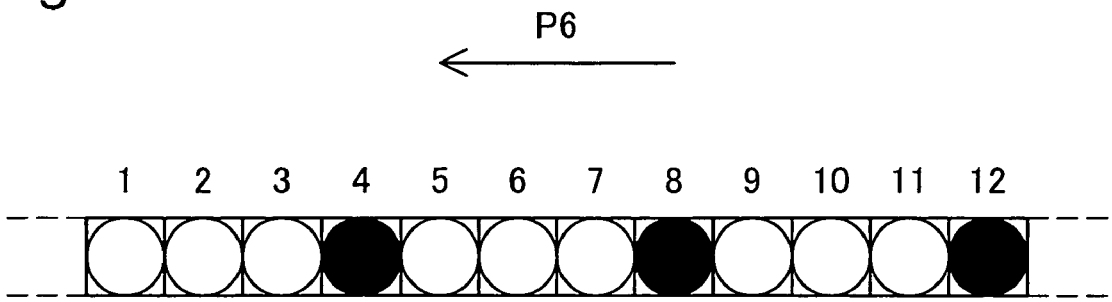

Taking line 21 in FIG. 15 as an example, the manner of recording dots onto a single main scan line shall be described chronologically. First, during main scan P1, dots are recorded by nozzle #9 onto pixels in line 21 with numbers leaving a remainder of 1 when divided by 4, as shown in FIG. 16A. As shown in FIG. 16B, no dots are recorded during main scan P2. Subsequently, in main scan P5, dots are recorded by nozzle #2 onto pixels of line 21 having numbers leaving a remainder of 2 when divided by 4, and pixels with numbers leaving a remainder of 3 when divided by 4, as shown in FIG. 16C. Finally, in main scan P6, dots are recorded by nozzle #2 onto pixels with numbers divisible by 4 with no remainder, as shown in FIG. 16D. In this way, dots are recorded onto all pixels of line 21.

Once the number of pixels N1 recorded by nozzles of the first nozzle group and the number of pixels N3 recorded by nozzles of the third nozzle group have been determined, printing so as to fulfill this condition can be realized through an arrangement like Embodiment 2.

C. Variations

While the invention has been shown and described through certain preferred embodiments, it is not limited thereto, and may be realized in various other modes without departing from the scope and spirit of the invention, as exemplified by the following variations.

In Embodiment 1, the area W2 of dot d2*s* (see FIG. 13) is 100, whereas the area W1 of dot d1*s* (see FIG. 11) is 160 and the area W3 of dot d3*s* (see FIG. 12) is 80. As a result, the ratio of the number of pixels N1 recorded by nozzles of the first nozzle group to the number of pixels N3 recorded by nozzles of the third nozzle group is 1:3. However, the ratio of N1 to N3 may be chosen arbitrarily. For example, if the area W2 of dot d2*s* is 100 whereas the area W1 of dot d1*s* is 300 and the area W3 of dot d2*s* is 50, N1:N3 will be 1:4. That is, it is sufficient for N1 and N3 to be values different from one another, and particular values for N1 and N3 may be selected so as to give the highest print quality. However, as ink droplets tend to spread out (see FIGS. 11–13), N3 will preferably be a value at least 2.5 times greater than N1, and more preferably at least 3 times greater than N1. Still more preferably, N3 will be at least 4 times greater than N1.

In the preceding embodiments, as shown in FIG. 8, the number of pixels N1 recorded by nozzles of the first nozzle group is less than the number of pixels N3 recorded by nozzles of the third nozzle group. This is because the area W1 of dot d1*s* shown in FIG. 11 is 180 and the area W3 of dot d3*s* shown in FIG. 12 is 80. That is, the area W3 of dot d3*s* more closely approximates the area W2 of dot d2*s* than does the area W1 of dot d1*s*.

If area W3 of dot d3*s* and the area W1 of dot d1*s* were to approximate W2 equally closely, the ratio for N1 and N3 fulfilling Equation (2) would be 1:1. If on the other hand, the area W1 of dot d1*s* more closely approximates the area W2 of dot d2*s* in FIG. 13 than does the area W3 of dot d3*s*, the relationship between N1 and N3 as determined in accordance with Equation (2) will be such that N1>N3. Accordingly, in the present invention, the relationship of N1>N3 may be possible. That is, the number of pixels N1 recorded by nozzles of the first nozzle group and the number of pixels N3 recorded by nozzles of the third nozzle group may be values suitably determined to give high print quality.

When printing is performed with various different values for the number of pixels N1 recorded by nozzles of the first nozzle group and the number of pixels N3 recorded by nozzles of the third nozzle group, and the particular combination (or ratio) of N1 and N3 giving the best print quality is adopted, it is conversely possible to calculate the ratio of W1 to W3 on the basis of Equation (1). Using W1 for W1*c* and W3 for W3*c*, and substituting W2*c* in the left side of the equation gives the following.

$$W2c=\{W1c\times N1/(N1+N3)\}+\{W3c\times N3/(N1+N3)\} \quad (5)$$

Where r1 is {N1/(N1+N3)} and r3 is {N3/(N1+N3)} each of which is calculated from N1 and N3 values obtained on the basis of actual printed results, Equation (5) is written as follows.

$$1=\{(W1c/W2c)\times r1\}+\{(W3c/W2c)\times r3\} \quad (6)$$

Since r1 and r3 can be calculated from combinations of N1 and N3 that afford high quality printed results in actual practice, a ratio for (W1*c*/W2*c*) and (W1*c*/W2*c*) can be derived from Equation (6) above. For example, assuming W2*c* to be 100, W1*c* and W3*c* can be derived on the basis of Equation (6) above.

In Embodiment 1, dots d1*s*, d2*s* and d3*s* are actually recorded, and N1 and N3 determined on the basis of these dots. In this case, W1, W2, and W3 in Equation 1 are the areas. However, where printing is performed with various different values for the number of pixels N1 recorded by nozzles of the first nozzle group and the number of pixels N3 recorded by nozzles of the third nozzle group, and the particular combination (or ratio) of N1 and N3 giving the best print quality is adopted, W1*c*, W2*c*, and W3*c* in Equation (6) can be construed as follows. In that situation, W1*c*, W2*c*, and W3*c* can be construed as the contribution ratio of a specific single dot in overall color balance. In other words, W1*c*, W2*c*, and W3*c* are indicators of the extent to which each of the dots d1, d2, and d3 recorded as shown in FIGS. 5–7 will stand out, and are indicators representing the extent to which each contributes to coloration of the particular color. W1*c* is the contribution ratio of dot d1, W2*c* is the contribution ratio of dot d2, and W3*c* is the contribution ratio of dot d3.

While contribution ratio may be thought of as being greater the larger the actual area of the dot, a proportional relationship does not always exist between the two. Contribution ratio calculated in this manner will vary with printing order, due to factors such as differences in the extent of penetration depending on the order of ink overstrike and/or ink depositing onto paper media. When setting the various parameters for printing, by taking into consideration contribution ratio calculated in the above manner when setting printing parameters, parameter setting can be performed so as to give high print quality.

In the preceding embodiments, nozzle pitch is 2. However, nozzle pitch could instead be 6 dots, 8 dots, or some other multiple k (where k is an integer equal to 1 or greater) of main scan line pitch. The printing head may include the nozzles other than the nozzles whose nozzle pitch is multiple k of main scan line pitch. In other words, the printing head may include some nozzles whose nozzle pitch is multiple k of main scan line pitch. Recording of dots onto pixels in a main scan line can be performed in the course of main scanning in a single direction, or in the course of main scanning in two directions.

In Embodiment 1, main scan lines having dots recorded thereon by the second nozzle group have dots recorded on all pixels therein in the course of a single main scan. Main scan lines having dots recorded thereon by the first and third nozzle groups have dots recorded on all pixels therein in the course of two main scans. In Embodiment 2, main scan lines having dots recorded thereon by the second nozzle group and main scan lines having dots recorded thereon by the first and third nozzle groups all have dots recorded on all pixels therein in the course of two main scans. However, the number of main scans required to record dots on all pixels in main scan lines is not limited to these. That is, main scan lines having dots recorded thereon by the second nozzle group and main scan lines having dots recorded thereon by the first and third nozzle groups could have dots recorded on all pixels therein in the course of three or more main scans. However, it should be noted that print quality is higher where the number of main scans needed to record dots on all pixels is greater for main scan lines having dots recorded thereon by the first and third nozzle groups than for main scan lines having dots recorded thereon by the second nozzle group.

In the preceding embodiments, for main scan lines on which overlap printing is performed, dots are recorded on all pixels of those main scan lines in the course of two main scans. However, this is not the only arrangement; dots could be recorded on all pixels therein in the course of three or more main scans. That is, during printing, all pixels could be recorded on those main scan lines in the course of several main scans, with each nozzle passing over a main scan line recording dots on different pixels in the main scan line. With such an arrangement, characteristics of any individual nozzle can be prevented from being reflected to any significant degree in a main scan line.

In the preceding embodiments, nozzles for ejecting ink of each color are arrayed in single columns, but the nozzles of the nozzle groups could instead be arrayed in two columns, or in three or more columns. The nozzles of the nozzle groups may also be arranged in columns that are arranged differently in the sub-scanning direction, i.e. a so-called "zigzag" arrangement. In the preceding embodiments, nozzle rows for cyan, magenta, yellow, and black provided in the print heads are arrayed in the main scanning direction, but the nozzle groups for expelling the colors could instead be provided at different locations in the sub-scanning direction SS. That is, the plurality of nozzles for ejecting ink of a particular given color could be arranged in the sub-scanning direction at a nozzle pitch which is some multiple k (where k is an integer equal to 2 or greater) of main scan line pitch.

In the various arrangements described above, the nozzle group which reaches the print medium relatively late during sub-scanning (i.e. the third nozzle group) is highly likely to record dots onto pixels whose adjacent surrounding pixels have dots previously recorded thereon. The nozzle group which reaches the print medium relatively early during sub-scanning (i.e. the first nozzle group) is highly likely to record dots onto pixels whose adjacent surrounding pixels have no dots recorded thereon. Thus, dots produced by ink droplets ejected by the nozzle group which reaches the print medium relatively late during sub-scanning are highly likely to be relatively small, while dots produced by ink droplets ejected by the nozzle group which reaches the print medium relatively early during sub-scanning are highly likely to be relatively large. Dots recorded by the nozzle group positioned between these nozzle groups (i.e. the second nozzle group) are highly likely to have size lying between that of dots produced by the other nozzle groups.

Accordingly, by setting the number of pixels recorded by the nozzle group which reaches the print medium relatively early and the number of pixels recorded by the nozzle group which reaches the print medium relatively late to appropriate values, the following benefits are obtained. Expected values for dots in areas recorded by the nozzle group which reaches the print medium relatively early and the nozzle group which reaches the print medium relatively late can be made to approximate in the size of dots in areas recorded exclusively by the nozzle group positioned between these nozzle groups (i.e. the second nozzle group). Print quality can be improved as a result.

In the preceding embodiments, the entire line recording is performed with the second nozzle group in which all pixels contained in main scan lines positioned facing the nozzles of the second nozzle group are targeted for dot recording. However, the entire line recording may not need to be performed. An arrangement as follows may be realized. During the main scanning, first partial line recording is performed using the first nozzle group, wherein some of pixels among pixels included in main scan lines positioned facing nozzles of the first nozzle group are targeted for dot recording. Second partial line recording is performed using the third nozzle group, wherein those pixels among pixels included in main scan lines positioned facing nozzles of the third nozzle group, and that have not previously had dots recorded thereon by the first nozzle group in previous main scans, are targeted for dot recording. In such an embodiment, the quality of printing result of the area which is recorded with the first and third nozzle groups can be approximate to the quality of the area which is recorded with only one nozzle group without some nozzle groups respectively.

In the preceding embodiments, an ink-jet printer was described, but the invention is not limited to ink-jet printers, and may be implemented generally in all manner of printing devices that use print heads. The invention is not limited to methods and devices that eject ink, and is applicable also to methods and devices that record dots by other means.

In the preceding embodiments, some of the arrangements realized through hardware may instead by substituted by software, and conversely some of the arrangements realized through software may instead by substituted by hardware. For example, some of the functions of CPU 41 shown in FIG. 2 could instead be performed by dedicates circuits or other hardware, and some of the functions of the print driver circuit 52 could be performed by software.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. Printing device which performs printing by ejecting ink droplets from a nozzle and depositing the ink droplets on a printing medium to form dots, comprising:

a print head equipped with a plurality of nozzles for ejecting ink droplets of a same given color, the plurality of nozzles including a prior nozzle group and a posterior nozzle group along a direction of sub-scanning in order from a nozzle group that first reaches a point over the print medium during sub-scanning, the posterior nozzle group being provided over an area equal in width to that of the prior nozzle group in the direction of sub-scanning;

a main scan drive unit for performing main scanning by moving at least one of the print head and the print medium;

a sub-scan drive unit for performing the sub-scanning by moving at least one of the print head and the print medium in a direction intersecting a direction of the main scanning; and a control unit for controlling the print head, the main scan drive unit, and the sub scan drive unit;

wherein the plurality of nozzles are arranged in the direction of sub-scanning at a nozzle pitch equivalent to a multiple k (k being an integer equal to 1 or greater) of a main scan line pitch;

during the main scanning, the control unit performs first partial line recording using the prior nozzle group, wherein some of pixels among pixels included in main scan lines positioned facing nozzles of the prior nozzle group are targeted for dot recording, and second partial line recording using the posterior nozzle group, wherein those pixels among pixels included in main scan lines positioned facing nozzles of the posterior nozzle group and that have not previously had dots recorded thereon by the prior nozzle group in previous main scans are targeted for dot recording;

the first and second partial line recording being performed in such a manner that a number N1 (N1 being a positive integer) of pixels are targeted for recording by nozzles of the prior nozzle group in the first partial line recording in a single main scan, a number N3 (N3 being a positive integer) of pixels are targeted for recording by nozzles of the posterior nozzle group in the second partial line recording in the single main scan, and the number N1 is a different value from the number N3.

2. Printing device according to claim 1, wherein the plurality of nozzles further includes a middle nozzle group provided in a position between the prior nozzle group and the posterior nozzle group in the direction of sub-scanning; and during the main scanning, the control unit further performs entire line recording using the middle nozzle group, wherein all pixels included in main scan lines positioned facing nozzles of the middle nozzle group are targeted for dot recording.

3. Printing device according to claim 1, wherein k is an integer equal to 2 or greater.

4. Printing device according to claim 1, wherein between the main scans, the control unit performs sub-scanning by a specific feed distance that approximates a width provided to the posterior nozzle group in the direction of sub-scanning.

5. Printing device according to claim 1, wherein the control unit performs the first partial line recording and the second partial line recording using values for N1 and N3 which are determined such that a value of W13, given by $$W13=\{W1\times N1/(N1+N3)\}+\{W3\times N3/(N1+N3)\}$$

approximates a value W2, where W1 denotes area of a dot when the dot is recorded by ejecting an ink droplet of specific weight from the nozzle onto a pixel surrounded by adjacent pixels having no dots recorded thereon;

W2 denotes area of a dot when the dot is recorded by ejecting an ink droplet of the specific weight from the nozzle onto a pixel that has an adjacent pixel which has a dot recorded thereon to one side thereof in the direction of sub-scanning, and remaining surrounding adjacent pixels which have no dots recorded thereon; and

W3 denotes area of a dot when the dot is recorded by ejecting an ink droplet of the specific weight from the nozzle onto a pixel that has two adjacent pixels each of which has a dot recorded thereon to both sides thereof in the direction of sub-scanning, and remaining surrounding adjacent pixels which have no dots recorded thereon.

6. Method for performing printing on a print medium using a printing device comprising a print head equipped with a plurality of nozzles for ejecting ink droplets of a same given color arranged at a nozzle pitch equivalent to a multiple k (k being an integer equal to 1 or greater) of a main scan line pitch, the plurality of nozzles including a prior nozzle group and a posterior nozzle group along a direction of sub-scanning in order from a nozzle group that first reaches a point over the print medium during sub-scanning, the posterior nozzle group being provided over an area equal in width to that of the prior nozzle group in the direction of sub-scanning, wherein the method comprises the steps of:

(a) depositing ink droplets onto the print medium to form dots while performing main scanning by moving at least one of the print head and the print medium; and (b) performing the sub-scanning by moving the print medium by a specific feed distance in a direction intersecting a direction of the main scanning, wherein the step (a) includes the steps of:

(a1) setting some of pixels among pixels included in main scan lines positioned facing nozzles of the prior nozzle group as targets for dot recording using the prior nozzle group, and (a2) setting those pixels among pixels included in main scan lines positioned facing nozzles of the posterior nozzle group and that have not previously had dots recorded thereon by the prior nozzle group in previous main scans as targets for dot recording using the posterior nozzle group, wherein the step (a1) includes the step of forming dots in such a manner that a number N1 (N1 being a positive integer) of pixels are targeted for recording by nozzles of the prior nozzle group in the step (a1) in a single main scan, a number N3 (N3 being a positive integer) of pixels are targeted for recording by nozzles of the posterior nozzle group in the step (a2) in the single main scan, and the number N1 is a different value from the number N3.

7. Printing method according to claim 6, wherein the plurality of nozzles further includes a middle nozzle group provided in a position between the prior nozzle group and the posterior nozzle group in the direction of sub-scanning; and the step (a) further includes the step of (a3) setting all pixels included in main scan lines positioned facing nozzles of the middle nozzle group as targets for dot recording using the middle nozzle group.

8. Printing method according to claim 6, wherein k is an integer equal to 2 or greater.

9. Printing method according to claim 6, wherein the step (b) includes the step of performing sub-scanning by a specific feed distance that approximates a width provided to the posterior nozzle group in the direction of sub-scanning.

10. Printing method according to claim 6, wherein the step (a1) includes the steps of:

setting N1 such that a value of W13, given by $$W13=\{W1\times N1/(N1+N3)\}+\{W3\times N3/(N1+N3)\}$$

approximates a value W2, and setting N1 of pixels as targets for dot recording, and the step (a2) includes the steps of:

setting N3 such that the value of W13, given by $$W13=\{W1\times N1/(N1+N3)\}+\{W3\times N3/(N1+N3)\}$$

approximates the value W2, and setting N3 of pixels as targets for dot recording, where W1 denotes area of a dot when the dot is recorded by ejecting an ink droplet of specific weight from the nozzle onto a pixel surrounded by adjacent pixels having no dots recorded thereon;

W2 denotes area of a dot when the dot is recorded by ejecting an ink droplet of the specific weight from the nozzle onto a pixel that has an adjacent pixel which has a dot recorded thereon to one side thereof in the direction of sub-scanning, and remaining surrounding adjacent pixels which have no dots recorded thereon; and

W3 denotes area of a dot when the dot is recorded by ejecting an ink droplet of the specific weight from the nozzle onto a pixel that has two adjacent pixels each of which has a dot recorded thereon to both sides thereof in the direction of sub-scanning, and remaining surrounding adjacent pixels which have no dots recorded thereon.

11. Computer program product for carrying out printing on a print medium using a computer, the computer being connected to a printing device having a print head with a plurality of nozzles for ejecting ink droplets of a same given color, the plurality of nozzles being arranged at a nozzle pitch equivalent to a multiple k (k being an integer equal to 1 or greater) of a main scan line pitch, and including a prior nozzle group and a posterior nozzle group along a direction of sub-scanning in order from a nozzle group that first reaches a point over the print medium during sub-scanning, the posterior nozzle group being provided over an area equal in width to that of the prior nozzle group in the direction of sub-scanning, the computer program product comprising:

a computer readable medium; and a computer program stored on the computer readable medium, the computer program comprising:

a first program for causing the computer to execute a function of depositing ink droplets onto the print medium to form dots while performing main scanning by moving at least one of the print head and the print medium; and a second program for causing the computer to execute a function of performing the sub-scanning by moving the print medium by a specific feed distance in a direction intersecting a direction of the main scanning, wherein the first program includes:

a third program for causing the computer to execute a function of setting some of pixels among pixels included in main scan lines positioned facing nozzles of the prior nozzle group as targets for dot recording using the prior nozzle group, and a fourth program for causing the computer to execute a function of setting those pixels among pixels included in main scan lines positioned facing nozzles of the posterior nozzle group and that have not previously had dots recorded thereon by the prior nozzle group in previous main scans as targets for dot recording using the posterior nozzle group, wherein the third program includes a sub-program for causing the computer to form dots in such a manner that number N1 (N1 being a positive integer) is a different value from number N3 (N3 being a positive integer), where N1 is a number of pixels which are targeted for recording by nozzles of the prior nozzle group by the third program in a single main scan, and N3 is a number of pixels which are targeted for recording by nozzles of the posterior nozzle group by the fourth program in the single main scan.

12. Computer program product according to claim 11, wherein the plurality of nozzles further includes a middle nozzle group provided in a position between the prior nozzle group and the posterior nozzle group in the direction of sub-scanning; and the computer program includes a fifth computer program for causing the computer to execute a function of setting all pixels included in main scan lines positioned facing nozzles of the middle nozzle group as targets for dot recording using the middle nozzle group.

13. Computer program product according to claim 11, wherein k is an integer equal to 2 or greater.

14. Computer program product according to claim 11, wherein the second program includes a sub-program for causing the computer to execute a function of performing sub-scanning by a specific feed distance that approximates a width provided to the posterior nozzle group in the direction of sub-scanning.

15. Computer program product according to claim 11, wherein the third program includes a sub-program for causing the computer to execute a function of:

setting N1 such that a value of W13, given by $$W13=\{W1\times N1(N1+N3)\}+\{W3\times N3/(N1+N3)\}$$

approximates a value W2, and setting N1 of pixels as targets for dot recording, and the fourth program includes a sub-program for causing the computer to execute a function of:

setting N3 such that the value of W13, given by $$W13=\{W1\times N1/(N1+N3)\}+\{W3\times N3/(N1+N3)\}$$

approximates the value W2, and setting N3 of pixels as targets for dot recording, where W1 denotes area of a dot when the dot is recorded by ejecting an ink droplet of specific weight from the nozzle onto a pixel surrounded by adjacent pixels having no dots recorded thereon;

W2 denotes area of a dot when the dot is recorded by ejecting an ink droplet of the specific weight from the nozzle onto a pixel that has an adjacent pixel which has a dot recorded thereon to one side thereof in the direction of sub-scanning, and remaining surrounding adjacent pixels which have no dots recorded thereon; and

W3 denotes area of a dot when the dot is recorded by ejecting an ink droplet of the specific weight from the nozzle onto a pixel that has two adjacent pixels each of which has a dot recorded thereon to both sides thereof in the direction of sub-scanning, and remaining surrounding adjacent pixels which have no dots recorded thereon.

* * * * *